US011376702B2

(12) United States Patent
Han et al.

(10) Patent No.: US 11,376,702 B2
(45) Date of Patent: Jul. 5, 2022

(54) INTEGRATED ROTARY CUTTING TOOL MANUFACTURING DEVICE AND METHOD

(71) Applicant: SHENZHEN JINZHOU PRECISION TECHNOLOGY CORPORATION, Guangdong (CN)

(72) Inventors: Qinghong Han, Guangdong (CN); Jian Zhu, Guangdong (CN); Junli Liu, Guangdong (CN)

(73) Assignee: SHENZHEN JINZHOU PRECISION TECHNOLOGY CORPORATION, Shenzhen (CN)

( * ) Notice: Subject to any disclaimer, the term of this patent is extended or adjusted under 35 U.S.C. 154(b) by 1003 days.

(21) Appl. No.: 16/056,583

(22) Filed: Aug. 7, 2018

(65) Prior Publication Data

US 2018/0339388 A1 Nov. 29, 2018

Related U.S. Application Data

(63) Continuation of application No. PCT/CN2016/092991, filed on Aug. 3, 2016.

(30) Foreign Application Priority Data

Feb. 24, 2016 (CN) ..... 201610102359.9

(51) Int. Cl.
*B24B 27/00* (2006.01)
*B24B 3/24* (2006.01)
(Continued)

(52) U.S. Cl.
CPC ..... *B24B 3/24* (2013.01); *B24B 27/0023* (2013.01); *B24B 27/0076* (2013.01);
(Continued)

(58) Field of Classification Search
CPC ..... B24B 27/0023; B24B 27/0046; B24B 27/0076; B24B 27/0084; B24B 3/24;
(Continued)

(56) References Cited

U.S. PATENT DOCUMENTS 4,833,764 A * 5/1989 Muller ..... B23Q 1/48 409/203
4,837,983 A * 6/1989 Fuller, Jr. ..... B24B 3/26 451/48
(Continued)

FOREIGN PATENT DOCUMENTS

CN 103567821 A * 2/2014 ..... B24B 3/24
KR 201330975 A * 11/2012 ..... B24B 27/0069

*Primary Examiner* — Joseph J Hail
*Assistant Examiner* — Arman Milanian

(57) ABSTRACT

The present disclosure discloses an integrated rotary cutting tool manufacturing device and method, the integrated rotary cutting tool manufacturing device comprises a workpiece transfer device, a machine body, a feeding device, grinding devices and a discharge device. The grinding devices comprise a rough grinding device used for carrying out primary grinding on a vertically arranged workpiece and a fine grinding device used for carrying out secondary grinding on the vertically arranged workpiece. The integrated rotary cutting tool manufacturing device is adopted by the rotary cutting tool manufacturing method. The device according to the present disclosure is compact in structure, high in machining efficiency and precision, and low in costs, the maximum values, the minimum values and the average values of the roundness and the concentricity of machined micro drill bits are closer to the standard values, and the stabilization process capability indexes of the roundness.

12 Claims, 14 Drawing Sheets

(51) Int. Cl.
*B24B 41/00* (2006.01)
*B24B 41/06* (2012.01)
*B24B 53/075* (2006.01)

(52) U.S. Cl.
CPC ..... *B24B 41/005* (2013.01); *B24B 41/06* (2013.01); *B24B 53/075* (2013.01)

(58) Field of Classification Search
CPC ..... B24B 41/005; B24B 41/06; B24B 47/12; B24B 47/20; B24B 47/22; B24B 51/00; B24B 53/06; B24B 53/075; B24B 3/26; B24B 3/247; B24B 3/28; B24B 3/30; B24B 19/04; B23B 51/011
USPC ..... 451/375, 48, 178, 10, 349; 76/5.1; 414/591, 730, 744.1, 744.7
See application file for complete search history.

(56) References Cited

U.S. PATENT DOCUMENTS 6,030,276 A * 2/2000 Mortell ..... G05B 19/182 451/5
6,331,133 B1 * 12/2001 Katayama ..... B24B 3/26 451/10
6,517,411 B2 * 2/2003 Mortell ..... B24B 3/247 451/48

* cited by examiner

INTEGRATED ROTARY CUTTING TOOL MANUFACTURING DEVICE AND METHOD

CROSS REFERENCE TO RELATED APPLICATION

The present application is a Continuation Application of PCT application No. PCT/CN2016/092991 filed on Aug. 3, 2016, which claims the benefit of Chinese patent application No. 201610102359.9 filed on Feb. 24, 2016. All the above are hereby incorporated by reference.

TECHNICAL FIELD

The present disclosure belongs to the field of workpiece grinding machining, and in particular relates to an integrated rotary cutting tool manufacturing device and method.

BACKGROUND

Generally, a cylindrical workpiece, such as a micro drill bit, is ground by utilizing a rough grinding and fine grinding integrated machining device which horizontally clamps the workpiece, that is, the workpiece is horizontally arranged and ground, wherein the workpiece is clamped by utilizing a flexible chuck, driven to rotate, and located by utilizing a V-shaped block; the feed manner of a grinding wheel utilizes an axial feed manner of the workpiece; a drill edge similar part of the workpiece is ground simultaneously by a rough grinding wheel and a fine grinding wheel; therefore, the flexible chuck and the V-shaped block are simultaneously acted on the shank of the workpiece to form over-location. When the workpiece rotates, the axial center shifts, thereby causing a large coaxiality error between the machined drill edge part and the shank; furthermore, the axial feed manner has low efficiency; besides, the rough grinding wheel and the fine grinding wheel are simultaneously acted on the workpiece, so that the rough grinding precision is hard to detect; according to the horizontal grinding manner, the floor space is large, and the size of the utilized device is large; and additionally, in the prior art, a tray is utilized to load the workpieces during feeding and discharging processes, so that a workpiece arrangement process needs to be additionally set before the feeding process, and the workpieces are arranged in the tray to add the processes and cause low production efficiency.

SUMMARY

An objective of the present disclosure is to provide an integrated rotary cutting tool manufacturing device and method in order to overcome disadvantages in the prior art, wherein the device is compact in structure, small in floor space and high in machining efficiency, and by adopting the machining method, workpieces are high in precision and low in costs.

A technical scheme provided by the present disclosure is: an integrated rotary cutting tool manufacturing device comprises a machine body, a feeding device used for loading workpieces to be ground, grinding devices used for grinding vertically arranged workpieces, and a discharge device used for loading ground workpieces, wherein the feeding device, the grinding devices and the discharge device all are connected with the machine body; the integrated rotary cutting tool manufacturing device further comprises a workpiece transfer device used for vertically transferring the workpieces to the grinding devices and the discharge device; and the grinding devices comprise a rough grinding device used for carrying out primary grinding on the vertically arranged workpieces and a fine grinding device used for carrying out secondary grinding on the vertically arranged workpieces.

Optionally, the feeding device, the rough grinding device, the fine grinding device and the discharge device are arranged around the circumference of the workpiece transfer device.

Optionally, the workpiece transfer device comprises a central rotating shaft capable of rotating relative to the machine body and manipulators connected with the central rotating shaft and used for clamping the workpieces, and the feeding device, the rough grinding device, the fine grinding device and the discharge device are arranged around the circumference of the central rotating shaft.

Optionally, a turning component is arranged on one side of the feeding device and is used for turning a horizontally arranged workpiece to be vertically arranged; the manipulators comprise a first manipulator component used for transferring the workpiece on the turning component to the rough grinding device, and the first manipulator component is connected with the central rotating shaft; the first manipulator component comprises a first clamping component used for clamping the workpiece and capable of lifting up and down and a rotation driving component used for driving the first clamping component to turn the workpiece to be in a vertical state, and the rotation driving component is connected with the first clamping component; and the manipulators further comprise a second manipulator component used for transferring the workpiece from the rough grinding device to the fine grinding device in the vertical state, and the second manipulator component comprises a second clamping component used for clamping the workpiece and capable of lifting up and down.

Optionally, the feeding device comprises a hopper used for containing horizontally arranged workpieces, the bottom of the hopper is provided with a discharge hole used for discharging the workpieces, a discharge rod used for pushing out the workpieces one by one is arranged below the discharge hole in a sliding manner, the discharge rod is provided with a workpiece pushing groove used for containing the workpieces that are discharged from the discharge hole, and the discharge rod is connected with a discharge driving component used for driving the discharge rod to slide.

Optionally, the rough grinding device comprises a rough-grinding clamping stand and a rough grinding wheel stand; the rough-grinding clamping stand comprises a first ejector pin used for propping against the bottom of a workpiece to locate the axial position of the workpiece and a first driving component used for clamping the workpiece and driving the workpiece to rotate; and the rough grinding wheel stand comprises a rough grinding wheel and a rough-grinding feed driving component used for driving the rough grinding wheel to feed in a radial direction.

Optionally, the fine grinding device comprises a fine-grinding clamping stand and a fine grinding wheel stand; the fine-grinding clamping stand comprises a second ejector pin used for propping against the bottom of a workpiece to locate the axial position of the workpiece and a second driving component used for clamping the workpiece and driving the workpiece to rotate; and the fine grinding wheel stand comprises a fine grinding wheel and a fine-grinding feed driving component used for driving the fine grinding wheel to feed in a radial direction.

Optionally, the second driving component comprises a second guide wheel capable of pressing the side face of the workpiece to drive the workpiece to rotate, a second intermediate friction wheel driven by the second guide wheel and a second pressing wheel driven by the second intermediate friction wheel and capable of pressing the side face of the workpiece to drive the workpiece to rotate, the second intermediate friction wheel is connected with the second guide wheel and the second pressing wheel, the second guide wheel is connected with a second rotation driving component used for driving the second guide wheel to rotate, the fine-grinding clamping stand further comprises a fine-grinding guide plate, and the second pressing wheel is further connected with a second pressing driving component used for driving the second pressing wheel to press the side face of the workpiece.

Optionally, the axial center of the second pressing wheel and the axial center of the workpiece are relatively inclined.

Optionally, the fine-grinding clamping stand further comprises a fine-grinding support used for supporting the workpiece in a radial direction to balance the pressure.

Optionally, the fine grinding wheel stand further comprises a fine-grinding lifting driving component used for driving the fine grinding wheel to slide in an axial direction and a fine-grinding angle adjusting plate used for adjusting an inclination angle of the fine grinding wheel relative to the workpiece.

Optionally, the fine grinding device further comprises a fine grinding wheel dresser used for dressing the fine grinding wheel, the fine grinding wheel dresser comprises a fine-grinding-wheel-dressing abrasive stone, a fine-grinding-wheel-dressing lifting sliding table used for adjusting the fine-grinding-wheel-dressing abrasive stone, and a fine-grinding-wheel-dressing feed sliding table used for controlling the fine-grinding-wheel-dressing abrasive stone to feed towards the fine grinding wheel; and the fine grinding wheel dresser further comprises a fine-grinding-wheel-dressing angle adjusting component used for adjusting an inclination angle of the fine-grinding-wheel-dressing abrasive stone relative to the fine grinding wheel.

Optionally, the fine grinding wheel dresser further comprises a base plate and a seat plate connected with the base plate, the fine-grinding-wheel-dressing feed sliding table comprises a transverse sliding table connected with the fine-grinding-wheel-dressing lifting sliding table, and the fine-grinding-wheel-dressing lifting sliding table comprises a longitudinal sliding table connected with the transverse sliding table; and the fine-grinding-wheel-dressing angle adjusting component comprises an angle adjusting plate, the angle adjusting plate is adjustably rotatably connected with the base plate through the first pin shaft, the longitudinal sliding table is connected with the angle adjusting plate, and the angle adjusting plate is connected with a zero-degree touch block.

Optionally, the discharge device comprises a tray, the tray is provided with a plurality of loading holes used for allowing longitudinal insertion of the workpiece, a transfer base used for taking over the workpiece is arranged above or on one side of the tray, the transfer base is provided with a transfer hole used for allowing longitudinal insertion of the workpiece, and the discharge device further comprises a discharge manipulator used for transferring the workpiece from the transfer base to one loading hole.

Embodiments of the present disclosure further provide a rotary cutting tool manufacturing method which adopts the above-mentioned integrated rotary cutting tool manufacturing device and comprises the following steps: loading a workpiece on the feeding device, vertically arranging the workpiece on the rough grinding device of the grinding devices through the workpiece transfer device, carrying out primary grinding on the vertically arranged workpiece in a radial feed manner through the rough grinding wheel of the rough grinding device, vertically arranging the workpiece on the rough grinding device of the grinding devices through the workpiece transfer device, transferring the workpiece from the rough grinding device to the fine grinding device through the workpiece transfer device, carrying out secondary grinding on the vertically arranged workpiece in the radial feed manner through the fine grinding wheel of the fine grinding device, and transferring the workpiece from the fine grinding device to the discharge device through the workpiece transfer device.

According to the integrated rotary cutting tool manufacturing device and method, provided by the present disclosure, the workpiece is in the vertical state during grinding machining, so that the clamping and driving manners of the workpiece are changed, and the clamping, driving and rotating operations of the workpiece are acted on the same part of a shank of the workpiece; and furthermore, it may ensure that the axial center of the workpiece does not shift during rotating, so that the coaxiality error between a machined drill edge part and the shank is reduced. During grinding, the axial feed of the workpiece is changed to the radial feed, so that the grinding manner is changed, and the grinding efficiency is improved. Furthermore, a rough grinding station and a fine grinding station are separated and independent, so that the rough grinding machining precision is easy to detect; and at the machining stations, the workpiece is vertically arranged, thereby facilitating arrangement of functional parts of the device and saving the floor area of the device. The hopper is utilized to feed the workpiece (the workpiece is horizontally arranged and stacked) according to the feeding manner, the tray is utilized to load the workpiece according to the discharge manner, and the workpiece is vertically and independently arranged in the loading hole of the tray, thereby helping the workpiece to directly enter the next process; and the manipulators move to transfer the workpiece, thereby omitting a manual workpiece transfer process and improving the production efficiency.

BRIEF DESCRIPTION OF THE DRAWINGS

In order to more clearly illustrate the technical schemes of the embodiments of the present disclosure, the following drawings will be briefly described in connection with the embodiments, and it will be obvious that the drawings in the following description are only some of the present disclosure and it will be apparent to those skilled in the art that other drawings may be obtained without departing from the scope of the inventive work in accordance with these drawings.

DESCRIPTION OF THE EMBODIMENTS

To make the objectives, technical schemes, and advantages of the present disclosure clearer and more comprehensible, the following further describes the present disclosure in detail with reference to the accompanying drawings and embodiments. It should be understood that the specific embodiments described herein are merely used to explain the present disclosure but are not intended to limit the present disclosure.

It should be noted that when a component is "fixed" or "disposed" on another component, the component may be placed on the another component directly or an intermediate component may exist. When a component is "connected" to another component, the component may be connected to the another component directly or an intermediate component may exist.

It should further be noted that orientation terms such as left, right, upper, and lower in the embodiments are merely relative concepts, or a normal use state of a product is used as a reference, but the terms should not be considered as restrictive.

Figure 1:
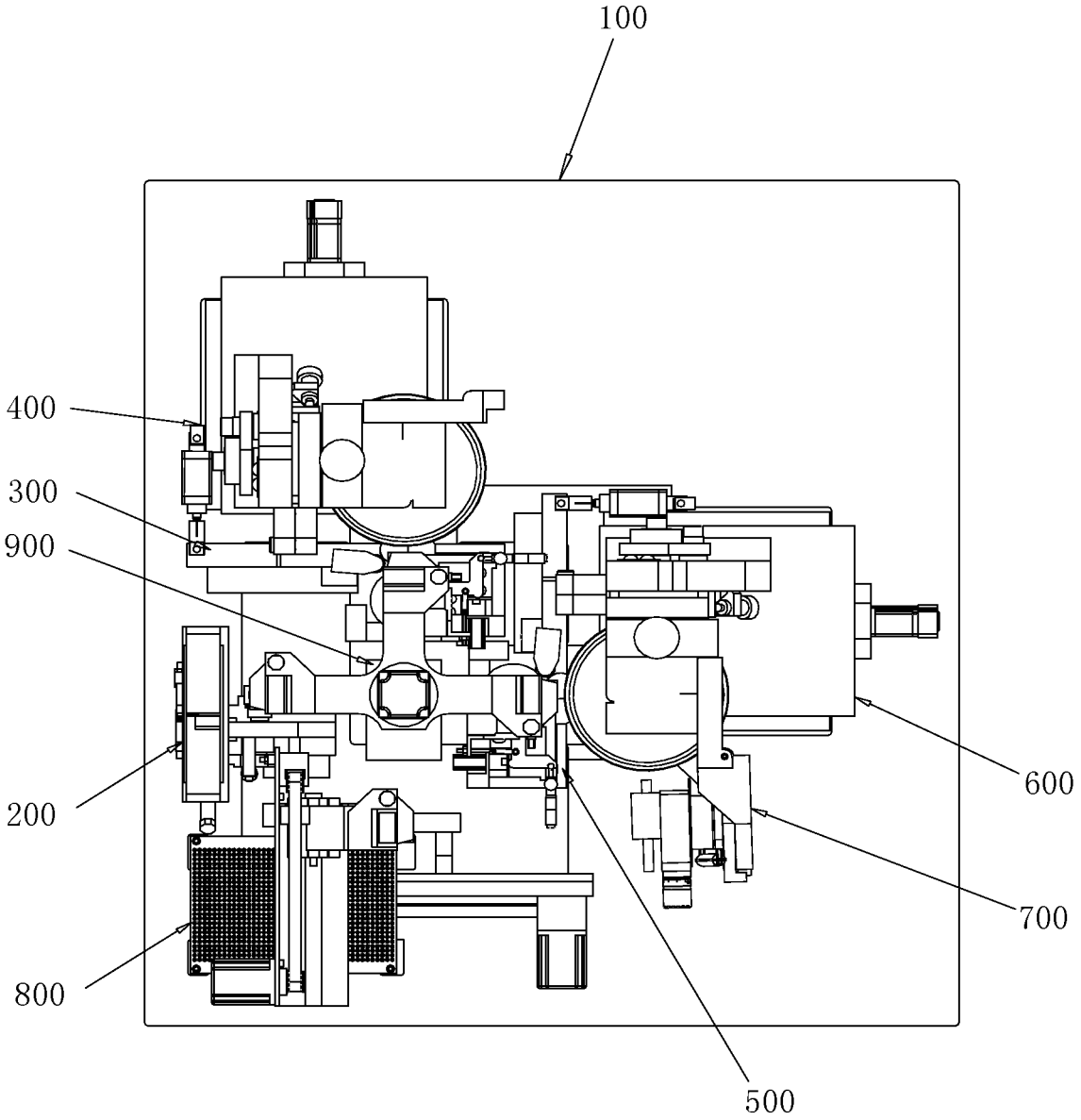
FIG. 1 is a plan schematic diagram of an integrated rotary cutting tool manufacturing device provided by embodiments of the present disclosure.
Figure 2:
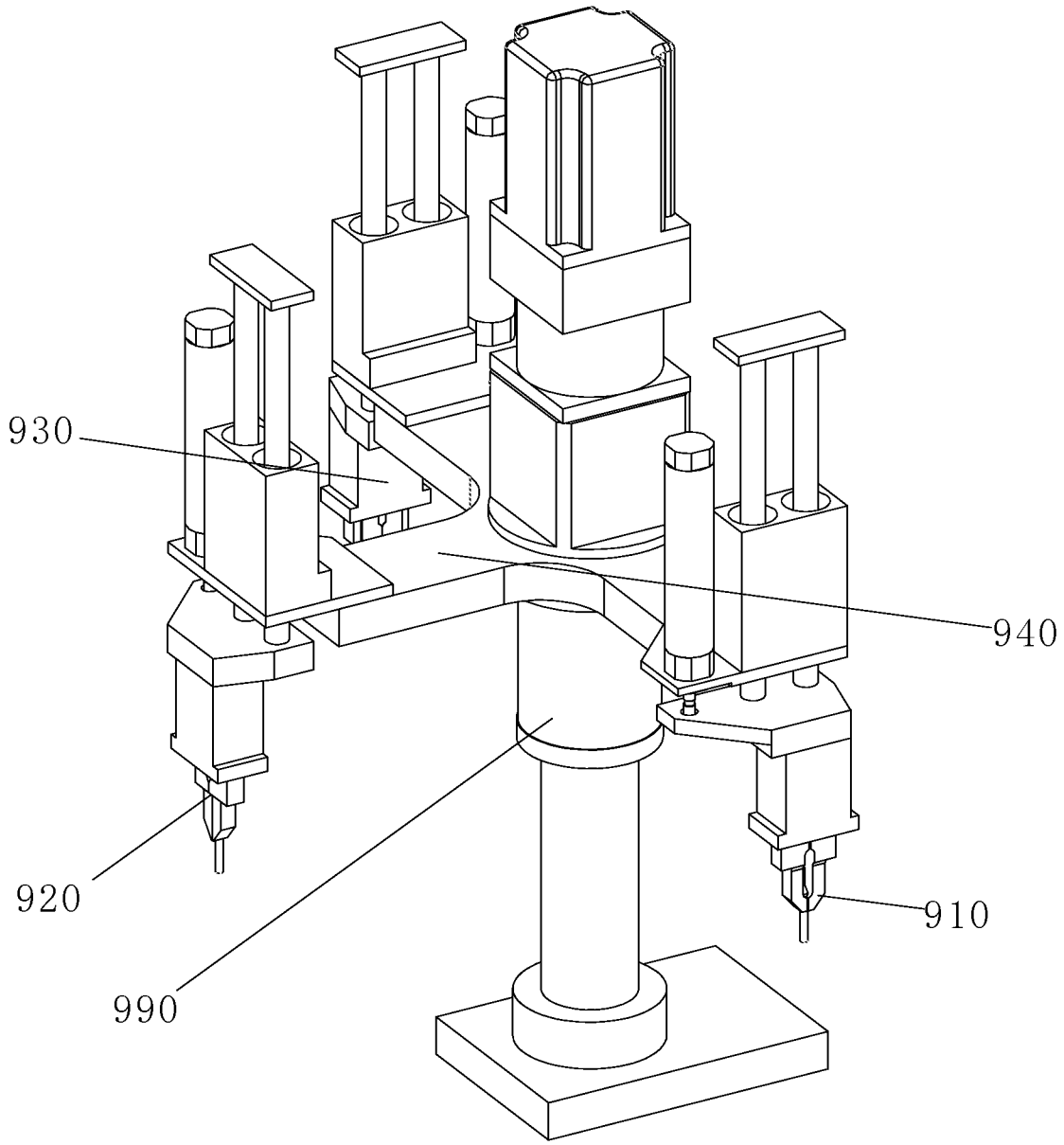
FIG. 2 is a stereo schematic diagram of a workpiece transfer device in the integrated rotary cutting tool manufacturing device provided by embodiments of the present disclosure.

As shown in FIG. 1 and FIG. 2, an integrated rotary cutting tool manufacturing device provided by embodiments of the present disclosure is applied to grinding machining of cylindrical workpieces, such as micro drill bits and the like. In the embodiments, a workpiece takes a micro drill bit for example, and the micro drill bit may comprise a drill edge part and a shank. The integrated rotary cutting tool manufacturing device comprises a machine body 100 (a rack), a feeding device 200 used for loading workpieces to be ground, grinding devices used for grinding vertically arranged workpieces, and a discharge device 800 used for loading ground workpieces, wherein the feeding device 200, the grinding devices and the discharge device 800 all are connected with the machine body 100; the integrated rotary cutting tool manufacturing device further comprises a workpiece transfer device 900 used for vertically transferring the workpieces to the grinding devices and the discharge device 800, and during grinding machining, the workpieces are in a vertical state, thereby facilitating arrangement of function parts of the device, ensuring the compact structure of the device and saving the floor area of the device; specifically, the grinding devices comprise a rough grinding device used for carrying out primary grinding on the vertically arranged workpieces and a fine grinding device used for carrying out secondary grinding on the vertically arranged workpieces, and the rough grinding device and the fine grinding device may respectively grind each workpiece. The rough grinding device and the fine grinding device both are connected with the machine body 100 and are arranged adjacent to each other, and a rough grinding station and a fine grinding station are separate and independent, so that the rough grinding precision is easy to detect; and certainly, an ultra-fine grinding device may be added according to requirements in order to carry out third grinding on the workpieces.

The feeding device 200, the rough grinding device, the fine grinding device and the discharge device 800 may be uniformly arranged around the circumference of the workpiece transfer device 900, specifically the feeding device 200, the rough grinding device, the fine grinding device and the discharge device 800 are arranged around the periphery of the workpiece transfer device 900 at every 90 degrees, and manipulators of the workpiece transfer device 900 may reach a next station or a previous station after rotating every 90 degrees.

Specifically, as shown in FIG. 1 and FIG. 2, the workpiece transfer device 900 comprises a central rotating shaft 990 and manipulators connected with the central rotating shaft 990 and used for clamping workpieces, the central rotating shaft 990 may be rotatably connected with the machine body 100, the manipulators may be connected with the central rotating shaft 990 through rotating arms 940, and a motor, an index plate and the like may drive and control a rotation angle of the central rotating shaft 990. The rough grinding device, the fine grinding device and the discharge device 800 are arranged around the circumference of the central rotating shaft 990 at every 90 degrees, so that the manipulators may rotate around the central rotating shaft 990 and lift up and down to clamp a workpiece and put down the workpiece at a corresponding station. The feeding device 200, the rough grinding device, the fine grinding device and the discharge device 800 may be uniformly distributed in the peripheral direction of the central rotating shaft 990 at every 90 degrees, and the manipulators may reach a previous station or a next station after rotating forwards or backwards 90 degrees. Certainly, the feeding device 200, the rough grinding device, the fine grinding device and the discharge device 800 may also be arranged in the shape of one transverse straight line or L, and correspondingly, the manipulators of the workpiece transfer device 900 may also be configured to move in the shape of one transverse straight line and the like. In the embodiments, transfer of the workpiece among the stations is achieved through moving and rotating of the manipulators.

Figure 3:
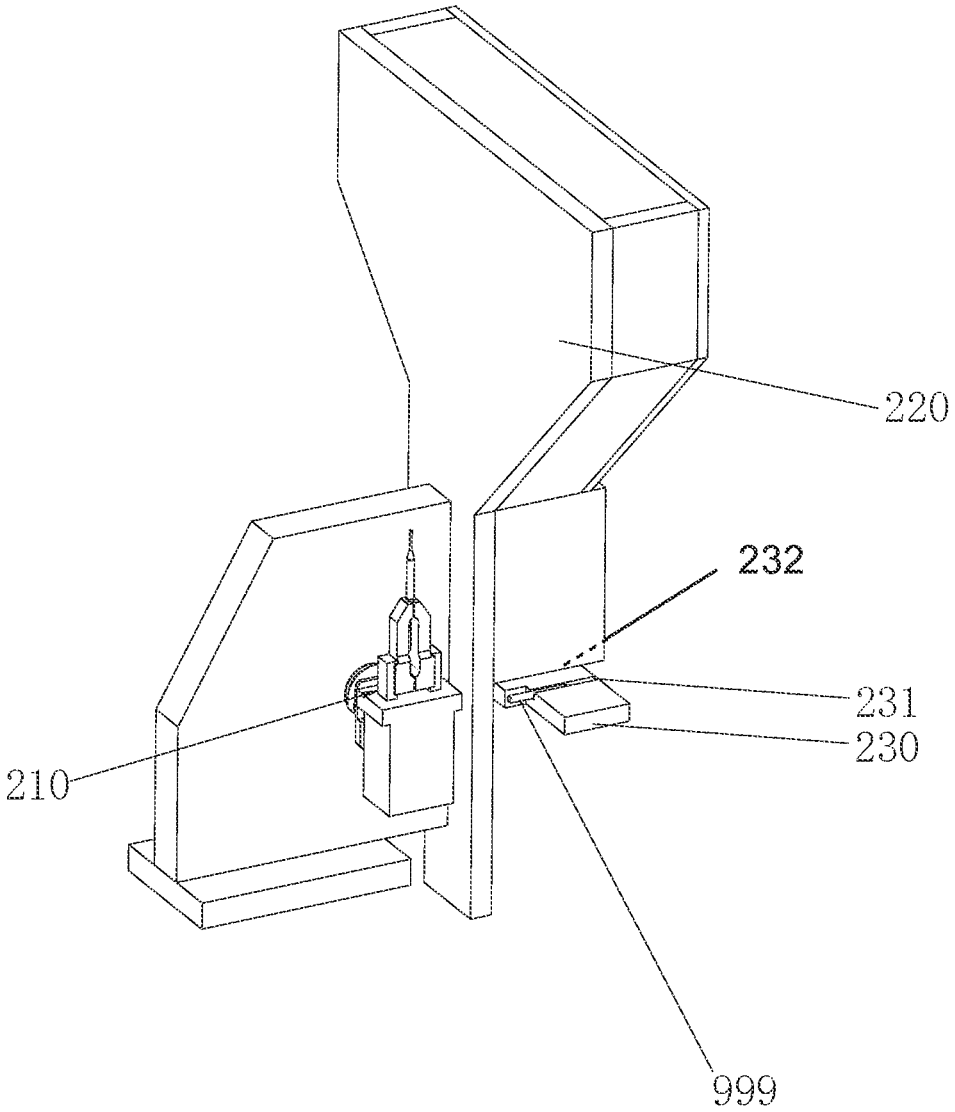
FIG. 3 is a stereo schematic diagram of a feeding device and a turning component in the integrated rotary cutting tool manufacturing device provided by embodiments of the present disclosure.

Specifically, as shown in FIG. 1 to FIG. 3, a turning component 210 is arranged on one side of the feeding device 200 and is used for turning a horizontally arranged workpiece to be vertically arranged; the manipulators comprise a first manipulator component 910 used for transferring the workpiece on the turning component 210 to the rough grinding device, and the first manipulator component 910 is connected with the central rotating shaft 990; the first manipulator component 910 comprises a first clamping component (a first manipulator) used for clamping the workpiece and capable of lifting up and down.

Specifically, the manipulators further comprise a second manipulator component 920 used for transferring the workpiece from the rough grinding device to the fine grinding device in a vertical state, and the second manipulator component 920 comprises a second clamping component (a second manipulator) used for clamping the workpiece and capable of lifting up and down. During specific application, the second clamping component may clamp the workpiece and lift up, rotate the central rotating shaft 990 to the fine grinding device, lift down, put the workpiece on the fine grinding device and then loosen the workpiece.

Specifically, as shown in FIG. 1 to FIG. 3, the feeding device 200 comprises a hopper 220 used for containing the horizontally arranged workpieces, the hopper 220 may be in the shape of a funnel, an opening is formed in the upper end of the hopper 220, and each workpiece may be horizontally centralized in the hopper 220. The bottom of the hopper 220 is provided with a discharge hole 232 used for discharging the workpieces, the horizontal workpieces may be discharged through the discharge hole 232 under the action of the gravity. A discharge rod 230 used for pushing out the workpieces one by one is arranged below the discharge hole 232 in a sliding manner, the discharge rod 230 is provided with a workpiece pushing groove 231 used for containing the workpieces that are discharged from the discharge hole 232, the workpiece pushing groove 231 may rightly contain one horizontal workpiece 999, the tail end of the workpiece 999 is protruded out of the workpiece pushing groove 231, the turning component 210 may clamp the tail end of the workpiece 999, the discharge rod 230 is connected with a discharge driving component used for driving the discharge rod 230 to slide reciprocatingly, and the discharge driving component may be a rectilinear motion actuator such as a lead-screw motor, a gear rack and the like. During specific application, the discharge rod 230 moves forwards to push the horizontal workpiece in the workpiece pushing groove 231 forwards, and the turning component 210 clamps and lifts up the workpiece in the workpiece pushing groove 231 and turns the workpiece 90 degrees to be in a vertical state. The turning component 210 may comprise a turning and clamping manipulator and a rotation driving component used for driving the turning and clamping manipulator to rotate 90 degrees forwards and backwards. The rotation driving component may be a motor, an air cylinder and the like.

Figure 4:
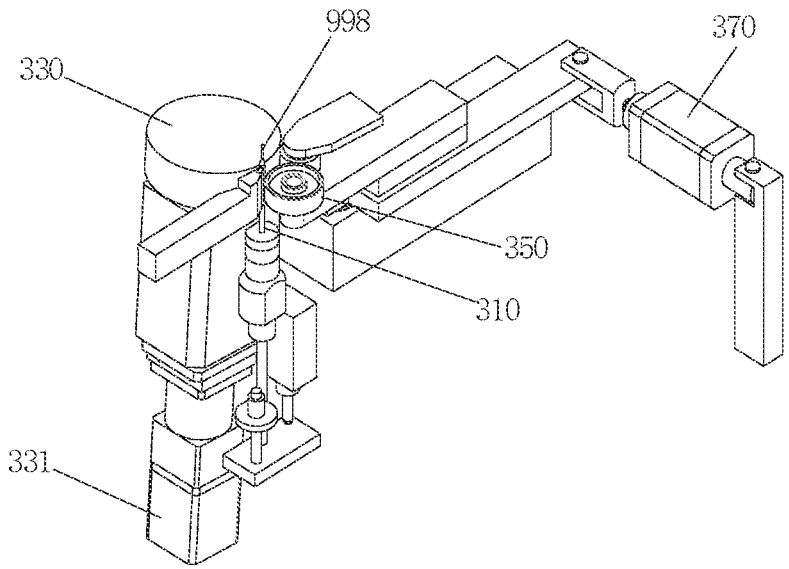
FIG. 4 is a stereo schematic diagram of a rough-grinding clamping stand in the integrated rotary cutting tool manufacturing device provided by embodiments of the present disclosure.
Figure 5:
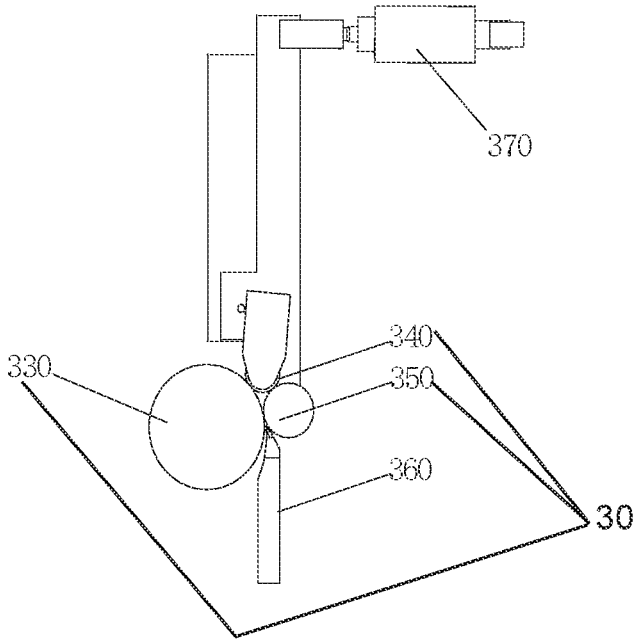
FIG. 5 is a plan schematic diagram of a rough-grinding clamping stand in the integrated rotary cutting tool manufacturing device provided by embodiments of the present disclosure.
Figure 6:
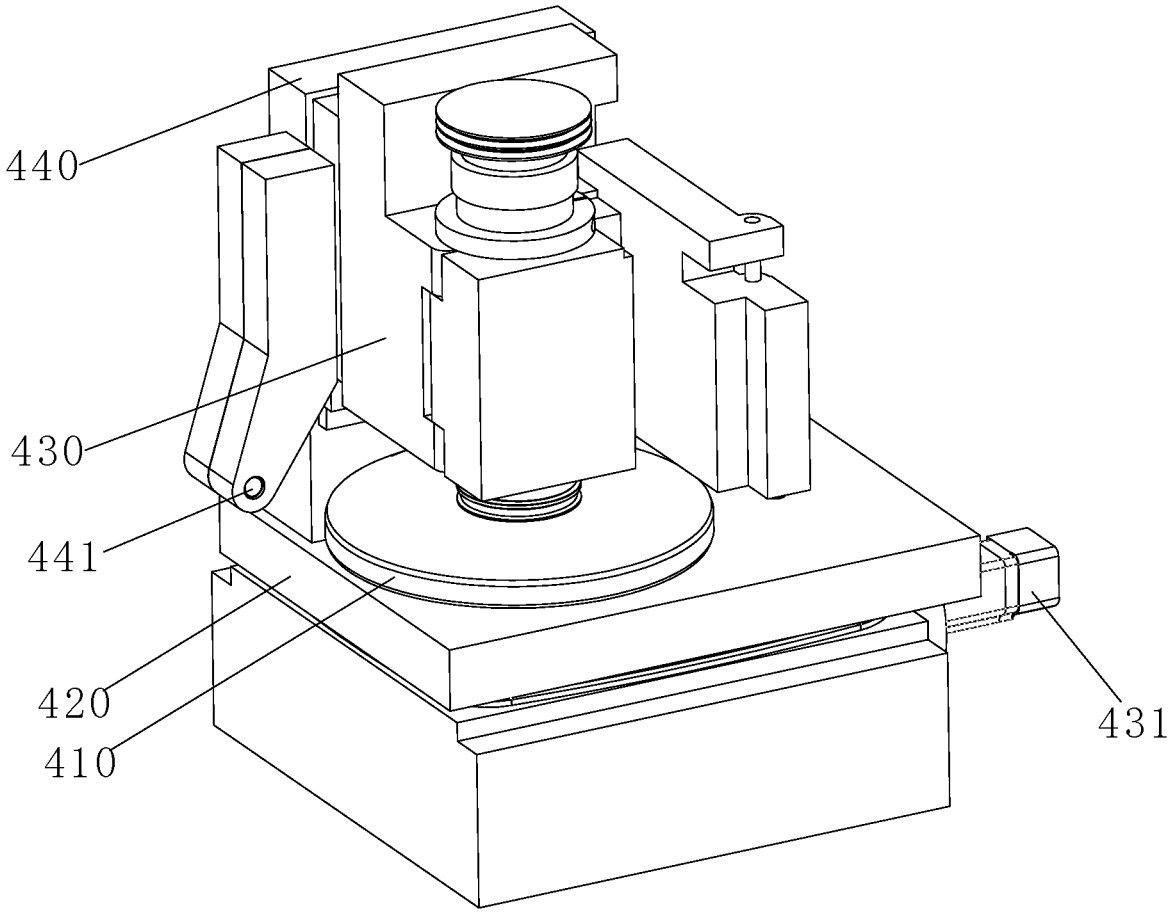
FIG. 6 is a stereo schematic diagram of a rough grinding wheel stand in the integrated rotary cutting tool manufacturing device provided by embodiments of the present disclosure.
Figure 7:
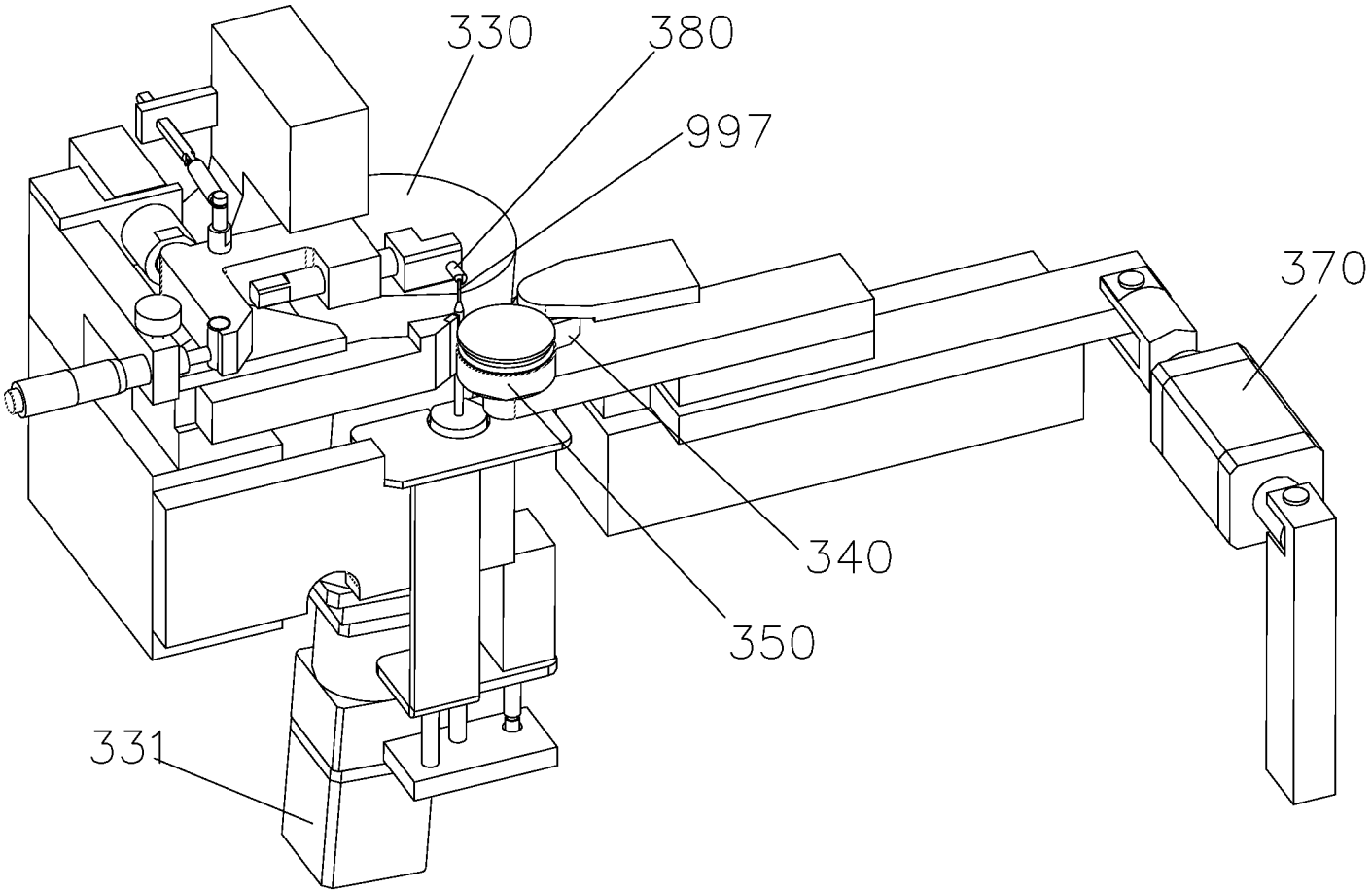
FIG. 7 is a stereo schematic diagram of a rough grinding device in the integrated rotary cutting tool manufacturing device provided by embodiments of the present disclosure.
Figure 8:
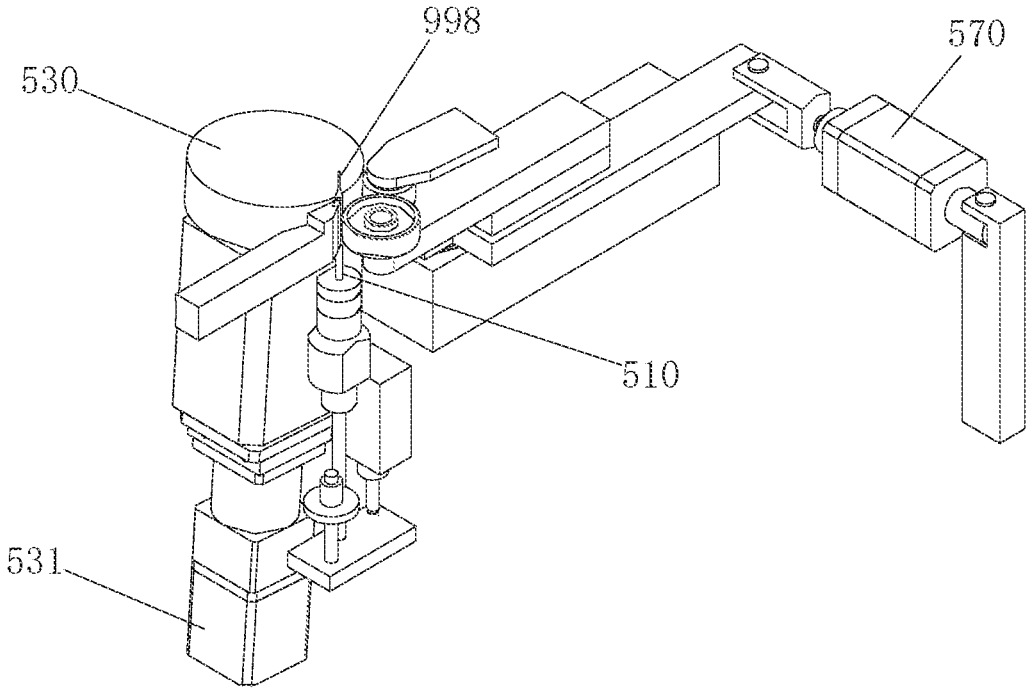
FIG. 8 is a stereo schematic diagram of a fine-grinding clamping stand in the integrated rotary cutting tool manufacturing device provided by embodiments of the present disclosure.
Figure 9:
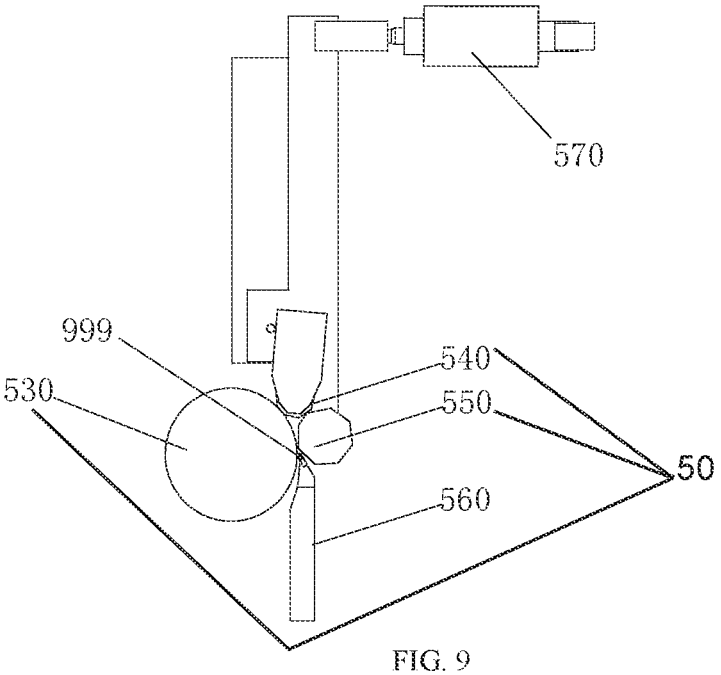
FIG. 9 is a plan schematic diagram of a fine-grinding clamping stand in the integrated rotary cutting tool manufacturing device provided by embodiments of the present disclosure.
Figure 10:
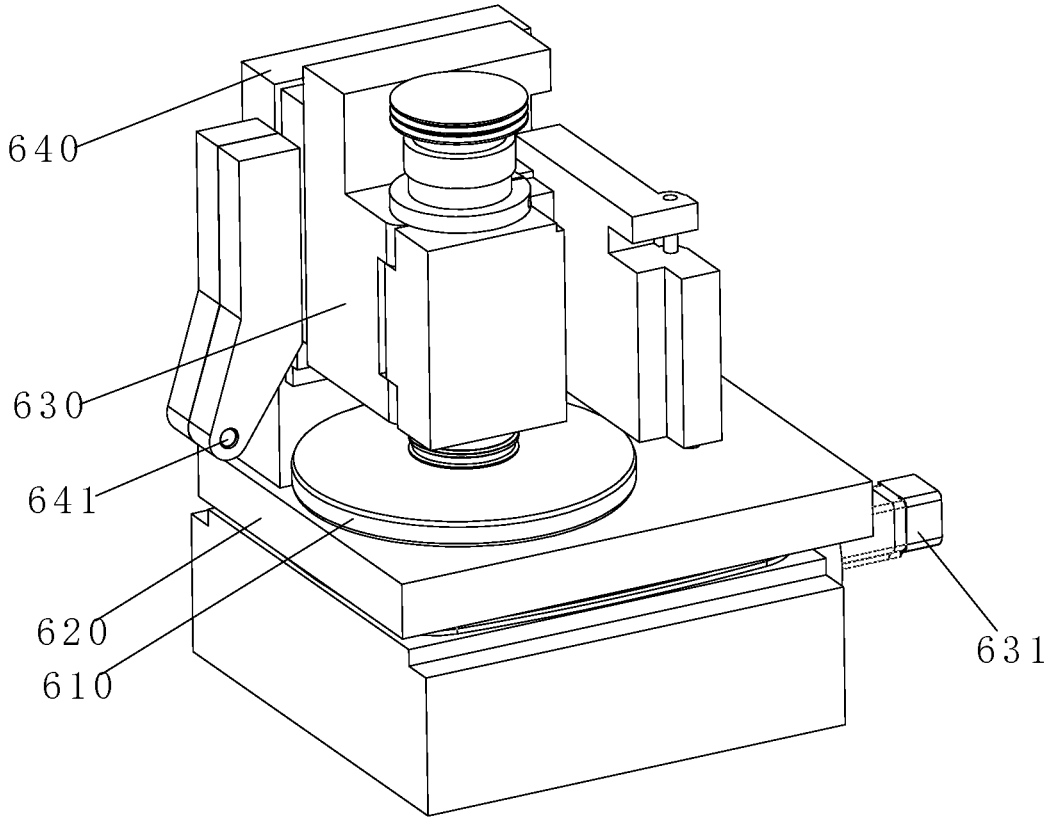
FIG. 10 is a stereo schematic diagram of a fine grinding wheel stand in the integrated rotary cutting tool manufacturing device provided by embodiments of the present disclosure.
Figure 11:
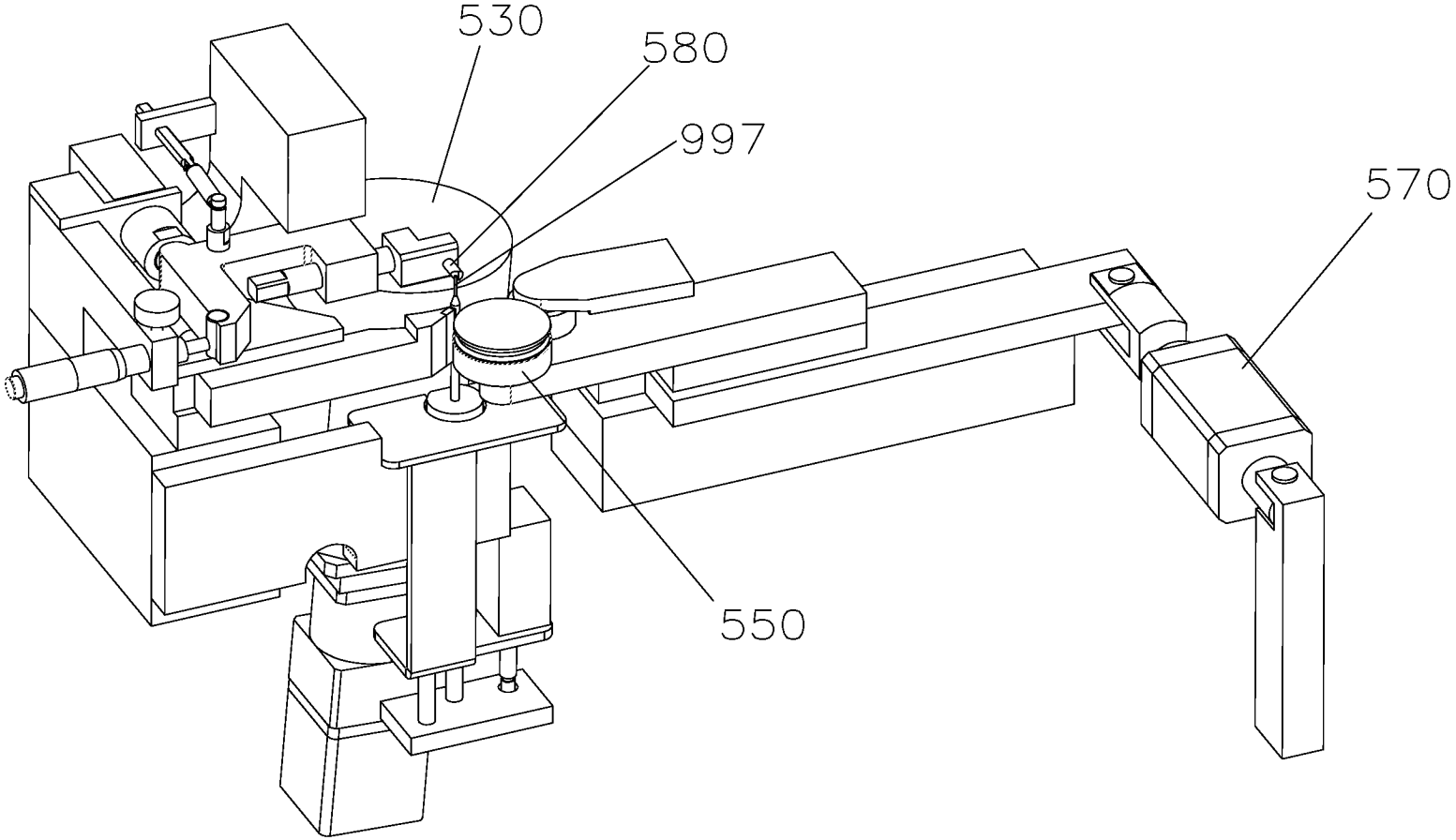
FIG. 11 is a stereo schematic diagram of a fine grinding device in the integrated rotary cutting tool manufacturing device provided by embodiments of the present disclosure.
Figure 12:
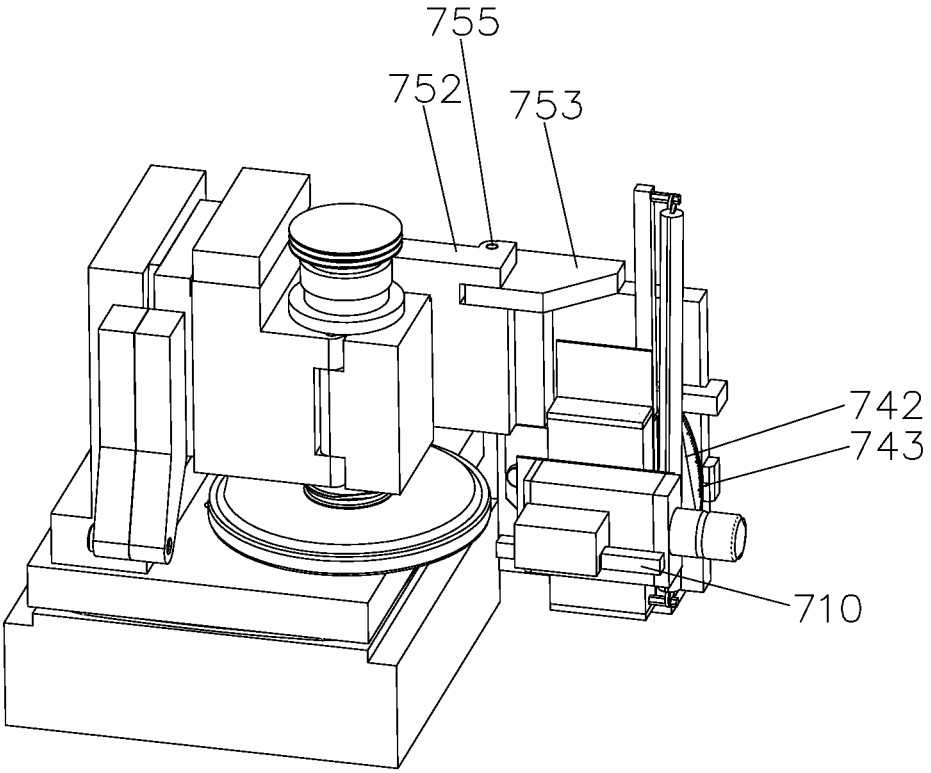
FIG. 12 is a stereo schematic diagram of a fine grinding wheel stand and a fine grinding wheel dresser in the integrated rotary cutting tool manufacturing device provided by embodiments of the present disclosure.
Figure 13:
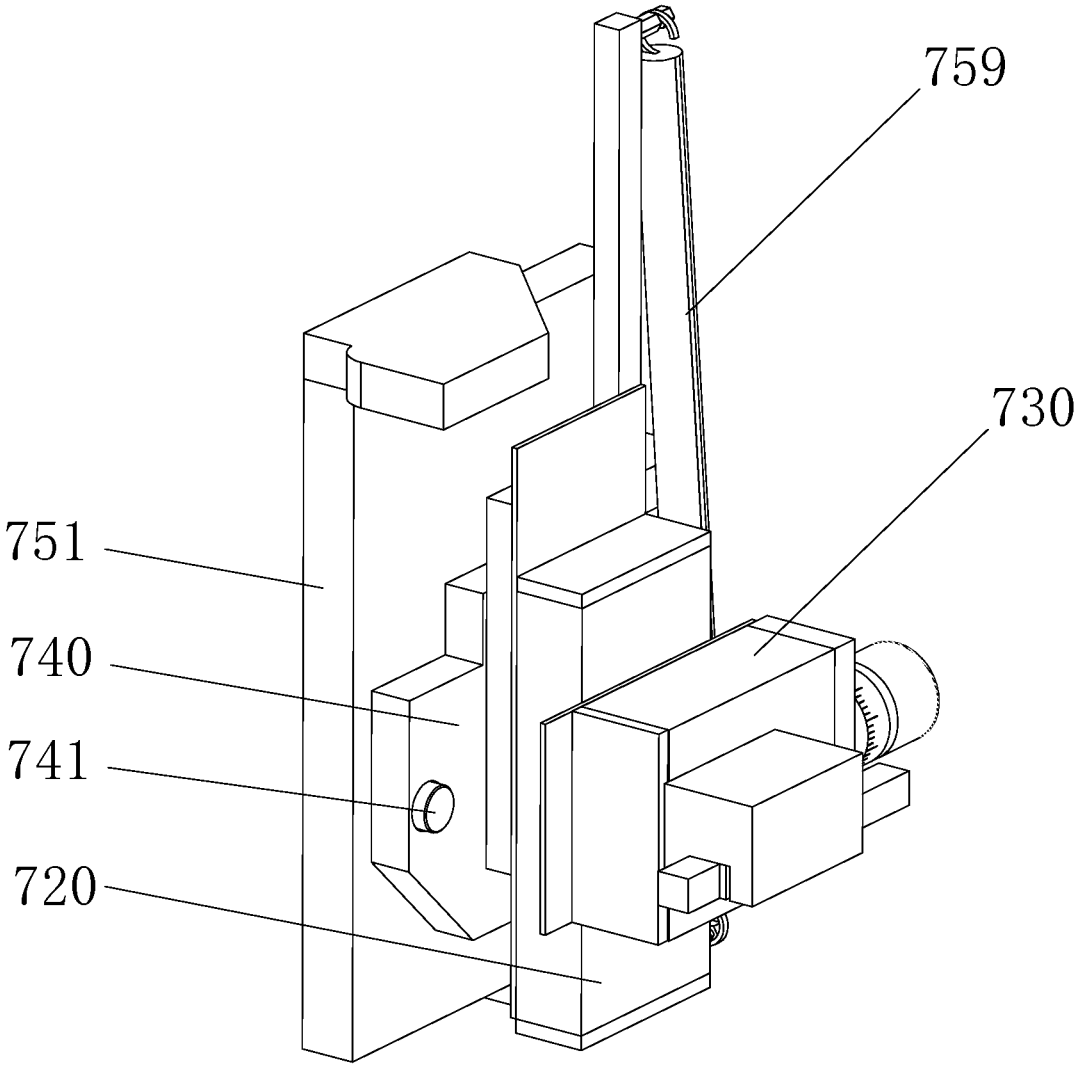
FIG. 13 is a stereo schematic diagram of a fine grinding wheel dresser in the integrated rotary cutting tool manufacturing device provided by embodiments of the present disclosure.

Specifically, as shown in FIG. 4 to FIG. 6, the rough grinding device comprises a rough-grinding clamping stand 300 and a rough grinding wheel stand 400, the rough-grinding clamping stand 300 comprises a first ejector 310 used for propping against the bottom of a workpiece 998 to locate the axial position of the workpiece 998 and a first driving component 30 used for clamping and driving the workpiece 998 to rotate, and the lower end of the workpiece 998 is propped against the upper end face of the first ejector pin 310. In the embodiments, the workpiece 998 is a micro drill bit, the bottom end of the shank of the micro drill bit is propped against the upper part of the first ejector pin 310, and the bottom of the first ejector pin 310 may be connected with a first lifting driving component used for driving the first ejector pin 310 to lift up and down; the rough grinding wheel stand 400 comprises a rough grinding wheel 410 and a driving component used for driving the rough grinding wheel 410 to rotate, and the driving component may be a motor. The rough grinding wheel stand 400 further comprises a rough-grinding feed driving component 431 used for driving the radial feed of the rough grinding wheel 410, so that the rough grinding wheel 410 is close to the drill edge part of the micro drill bit in a radial direction. The first driving component and the rough grinding wheel 410 may be connected with the rough-grinding feed sliding table 420, the rough-grinding feed sliding table 420 may be connected with the rough-grinding feed driving component 431, and the rough-grinding feed driving component 431 may be a motor.

Specifically, as shown in FIG. 4 to FIG. 6, the first driving component 30 comprises a first guide wheel 330 capable of pressing the side face of the workpiece to drive the workpiece to rotate, a first intermediate friction wheel 340 driven by the first guide wheel 330 and a first pressing wheel 350 driven by the first intermediate friction wheel 330 and capable of pressing the side face of the workpiece 998 to drive the workpiece to rotate. The first intermediate friction wheel 340 is connected with the first guide wheel 330 and the first pressing wheel 350, the first guide wheel 330 is connected with a first rotation driving component 331 used for driving the first guide wheel 330 to rotate, and the first intermediate friction wheel 340 is in contact with the first pressing wheel 350 and the first guide wheel 330 and carries out friction drive. The rough-grinding clamping stand 300 further comprises a rough-grinding guide plate 360, the first pressing wheel 350 is further connected with a first pressing driving component 370 used for driving the first pressing wheel 350 to press the workpiece on the first pressing driving component 370 of the rough-grinding guide plate 360 in the radial direction, that is, the first guide wheel 330 drives the first intermediate friction wheel 340, the first intermediate friction wheel 340 drives the first pressing wheel 350, and the angular speeds of the first pressing wheel 350 and the first guide wheel 330 are stable without speed difference, so, when the workpiece rotates, the rotation of the workpiece may keep stable, the axial center does not shift, the coaxiality error between the machined drill edge part and the shank is reduced, and the machining precision is improved. The first pressing driving component 370 may be an air cylinder or an oil cylinder. By utilizing the friction drive manner, the drive structure is simple, the drive is stable, the wheels may slip under an overload state to avoid damage, and the first driving component is easy to maintain. The first pressing driving component 370 may comprise an air cylinder and a pressing lever pushed by the air cylinder, a driving shaft of the air cylinder may be connected with one end of the pressing lever, and the first pressing wheel 350 may be rotatably connected with the other end of the pressing lever.

Specifically, as shown in FIG. 4 to FIG. 6, the axial center of the first pressing wheel 350 and the axial center of the workpiece 998 are inclined relatively, which may ensure that the end face (namely the bottom end face) of the shank of the workpiece is closely leaned against the head end face of the first ejector pin 310 when the workpiece 998 rotates, thereby facilitating length control of a to-be-machined part of the workpiece.

Specifically, as shown in FIG. 4 to FIG. 7, the rough-grinding clamping stand 300 further comprises a rough-grinding support 380 used for supporting the workpiece in the radial direction to balance the pressure so as to balance a pushing force generated when the rough grinding wheel 410 grinds the drill edge part 997 of the workpiece and ensure the machining precision. The rough-grinding support 380, the first pressing wheel 350 and the first guide wheel 330 may be uniformly distributed on the periphery of the workpiece and be in contact with the workpiece.

Specifically, as show in FIG. 4 to FIG. 7, the rough grinding wheel stand 400 further comprises a rough-grinding lifting sliding plate 430 used for driving the rough grinding wheel 410 to slide in an axial direction and a rough-grinding angle adjusting plate 440 used for adjusting an inclination angle of the rough grinding wheel 410 relative to the workpiece in order to be suitable for machining different-specification workpieces. The rough-grinding feed sliding table 420 may be connected with the rough-grinding lifting sliding plate 430, and the rough-grinding lifting sliding plate 430 may be connected with the rough-grinding angle adjusting plate 440. Or, the rough-grinding feed sliding table 420 may be connected with the rough-grinding angle adjusting plate 440, and the rough-grinding angle adjusting plate 440 may be connected with the rough-grinding lifting sliding plate 430. Therefore, a rotation angle of the rough-grinding angle adjusting plate 440 around the rotating shaft 441 may be adjusted, and the taper of the drill edge part to be roughly ground may be adjusted.

Specifically, as shown in FIG. 8 to FIG. 11, the fine grinding device comprises a fine-grinding clamping stand 500 and a fine grinding wheel stand 600, and the fine-grinding clamping stand 500 comprises a second ejector pin 510 used for propping against the bottom of the workpiece 998 to locate the axial position of the workpiece 998 and a second driving component 50 used for clamping the workpiece and driving the workpiece to rotate. In the embodiments, the workpiece 998 is a micro drill bit; and at a fine-grinding station, the bottom end of the shank of the micro drill bit is propped against the upper part of the second ejector pin 510, and the bottom of the second ejector pin 510 may be connected with a second lifting driving component used for driving the second ejector pin 510 to lift up and down. The fine grinding wheel stand 600 comprises a fine grinding wheel 610 and a fine-grind feed driving component 631 used for driving the radial feed of the fine grinding wheel 610, so that the fine grinding wheel 610 is close to the drill edge part of the micro drill bit in a radial direction. The fine grinding wheel 610 may be connected with the fine-grinding feed sliding table 620, and the fine-grinding feed sliding table 620 may be connected with the fine-grinding feed driving component 631.

Specifically, as shown in FIG. 8 to FIG. 11, the second driving component 50 comprises a second guide wheel 530 capable of pressing the side face of the workpiece 998 to drive the workpiece 998 to rotate, a second intermediate friction wheel 540 driven by the second guide wheel 530 and a second pressing wheel 550 driven by the second intermediate friction wheel 540 and capable of pressing the side face of the workpiece 998 to drive the workpiece 998 to rotate, the two sides of the second intermediate friction wheel 540 are respectively connected with the second guide wheel 530 and the second pressing wheel 550, the second guide wheel 530 is connected with a second rotation driving component 531 used for driving the second guide wheel 530 to rotate, the fine-grinding clamping stand 500 further comprises a fine-grinding guide plate 560, and the second pressing wheel 550 is further connected with a second pressing driving component 570 used for driving the second pressing wheel 550 to press the workpiece on the second pressing driving component 570 of the fine-grinding guide plate 560 in the radial direction, that is, the second guide wheel 530 drives the second intermediate friction wheel 540, the second intermediate friction wheel 540 drives the second pressing wheel 550, and the angular speeds of the second pressing wheel 550 and the second guide wheel 530 are stable without speed difference, so, the rotation of the workpiece may keep stable, and the machining precision is improved.

Specifically, as shown in FIG. 8 to FIG. 11, the axial center of the second pressing wheel 550 and the axial center of the workpiece 998 are inclined relatively, which may ensure that the end face (namely the bottom end face) of the shank of the workpiece is closely leaned against the head end face of the second ejector pin 510 when the workpiece rotates, thereby facilitating length control of a to-be-machined part of the workpiece.

Specifically, as shown in FIG. 8 to FIG. 11, the fine-grinding clamping stand 500 further comprises a fine-grinding support 580 used for supporting the workpiece in the radial direction to balance the pressure so as to balance a pushing force generated when the fine grinding wheel 610 grinds the drill edge part 997 of the workpiece and ensure the machining precision.

Specifically, as show in FIG. 8 to FIG. 11, the fine grinding wheel stand 600 further comprises a fine-grinding lifting driving component 630 used for driving the fine grinding wheel 610 to slide in the axial direction and a fine-grinding angle adjusting plate 640 used for adjusting an inclination angle of the fine grinding wheel 610 relative to the workpiece in order to be suitable for machining different-specification workpieces. Therefore, a rotation angle of the fine-grinding angle adjusting plate 640 around the rotating shaft 641 may be adjusted, and the taper of the drill edge part 997 to be finely ground may be adjusted.

Specifically, as show in FIG. 10 to FIG. 13, the fine grinding device further comprises a fine grinding wheel dresser 700 used for dressing the fine grinding wheel 610, the fine grinding wheel dresser 700 comprises a fine-grinding-wheel-dressing abrasive stone 710, a fine-grinding-wheel-dressing lifting sliding table 720 used for adjusting the fine-grinding-wheel-dressing abrasive stone 710, and a fine-grinding-wheel-dressing feed sliding table 730 used for controlling the fine-grinding-wheel-dressing abrasive stone 710 to feed towards the fine grinding wheel 610; and the fine grinding wheel dresser 700 further comprises a fine-grinding-wheel-dressing angle adjusting component used for adjusting an inclination angle of the fine-grinding-wheel-dressing abrasive stone 710 relative to the fine grinding wheel 640. The fine-grinding-wheel-dressing lifting sliding table 720 may be a vertical sliding table, and the fine-grinding-wheel-dressing feed sliding table 730 may be a transverse sliding table.

Specifically, as show in FIG. 10 to FIG. 13, the fine grinding wheel dresser 700 further comprises a base plate 751 and a seat plate 752 connected with the base plate 751, the fine-grinding-wheel-dressing feed sliding table 730 comprises a transverse sliding table connected with the fine-grinding-wheel-dressing lifting sliding table 720, and the fine-grinding-wheel-dressing lifting sliding table 720 comprises a longitudinal sliding table connected with the transverse sliding table; and the fine-grinding-wheel-dressing angle adjusting component comprises an angle adjusting plate 740, the angle adjusting plate 740 is adjustably rotatably connected with the base plate 751 through a first pin shaft 741, the longitudinal sliding table is connected with the angle adjusting plate 740, and the angle adjusting plate 740 is connected with a zero-degree touch block. The angle adjusting plate 740 may be connected with a spring 759.

Specifically, as show in FIG. 10 to FIG. 13, the angle adjusting plate 740 is connected with an angle index block 742, and the seat plate 752 is connected with a pointer 743 used for matching with the angle index block 742.

Specifically, as show in FIG. 10 to FIG. 13, a hook plate 753 is connected between the base plate 751 and the seat body, and the hook plate 753 is in locking type rotational connection with the base plate 751 or/and the seat plate 752.

Figure 14:
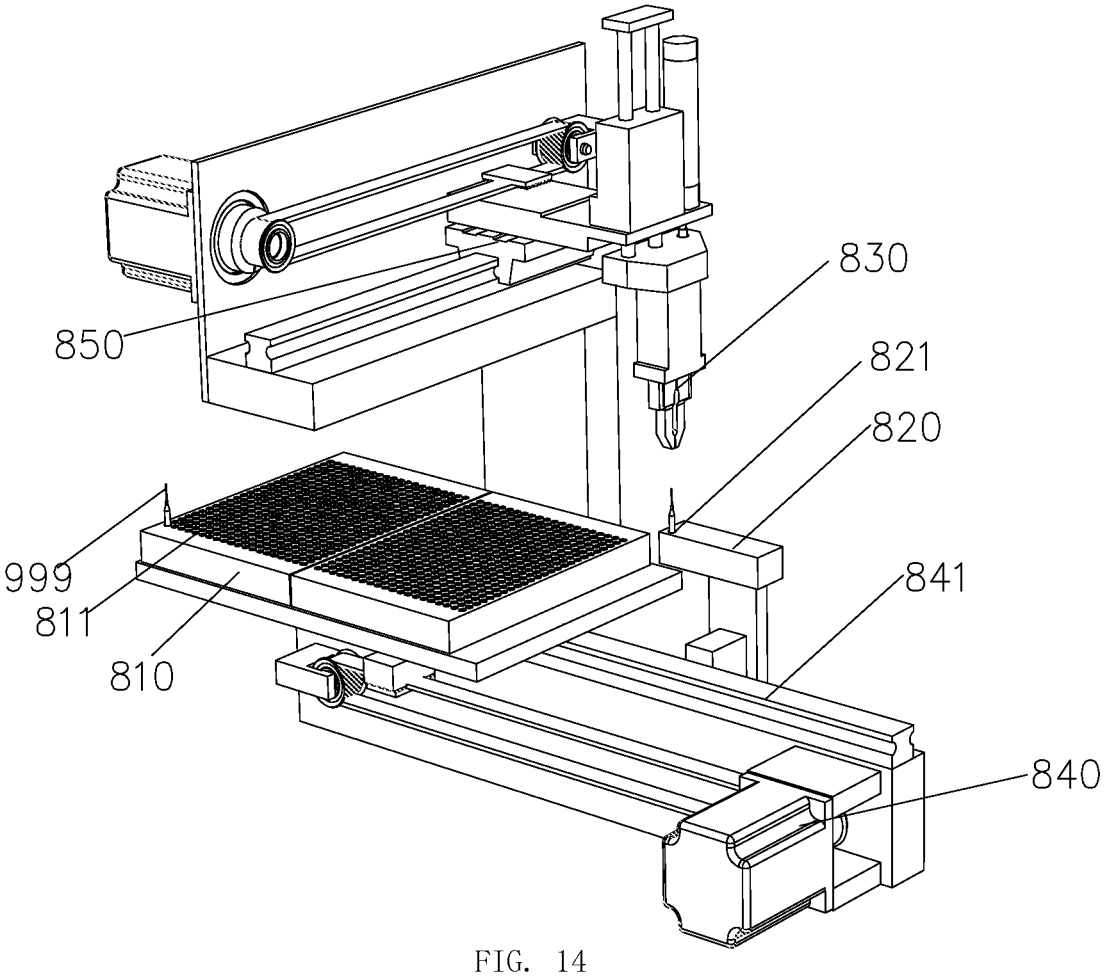
FIG. 14 is a stereo schematic diagram of a discharge device in the integrated rotary cutting tool manufacturing device provided by embodiments of the present disclosure.

Specifically, as show in FIG. 14, the discharge device 800 comprises a tray 810, the tray 810 is provided with a plurality of loading holes 811 used for allowing longitudinal insertion of the workpiece 999, a transfer base 820 used for taking over the workpiece is arranged above or on one side of the tray 810, the transfer base 820 is provided with a transfer hole 821 used for allowing longitudinal insertion of the workpiece, the discharge device 800 further comprises a discharge manipulator 830 used for transferring the workpiece from the transfer base 820 to one loading hole 811, and the discharge manipulator 830 may be located above or on one side of the tray 810.

Specifically, as show in FIG. 2 and FIG. 14, the manipulators further comprise a third manipulator component 930 (a third manipulator) used for transferring the workpiece from the fine-grinding device to the transfer hole in the vertical state, and the third manipulator component 930 comprises a third clamping component used for clamping the workpiece and capable of lifting up and down.

Figure 15:
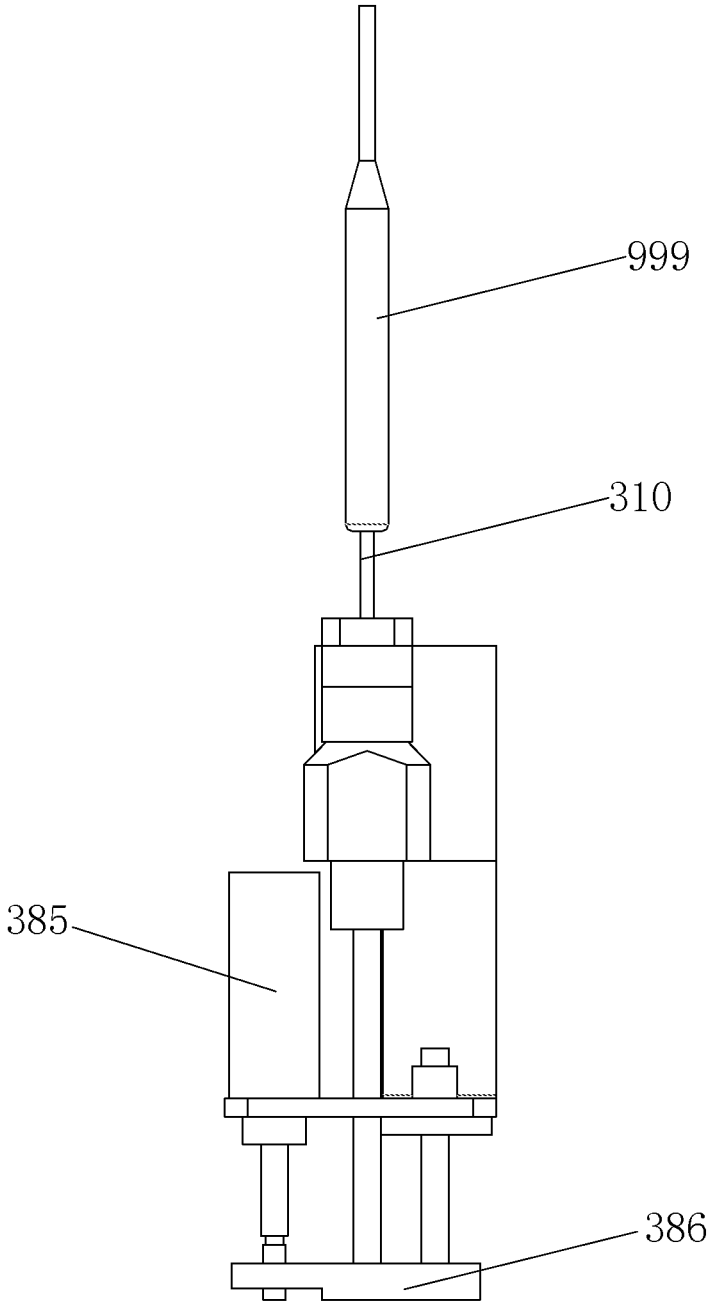
FIG. 15 is a plan schematic diagram of a rough-grinding axial-direction locating device in the integrated rotary cutting tool manufacturing device provided by embodiments of the present disclosure.
Figure 16:
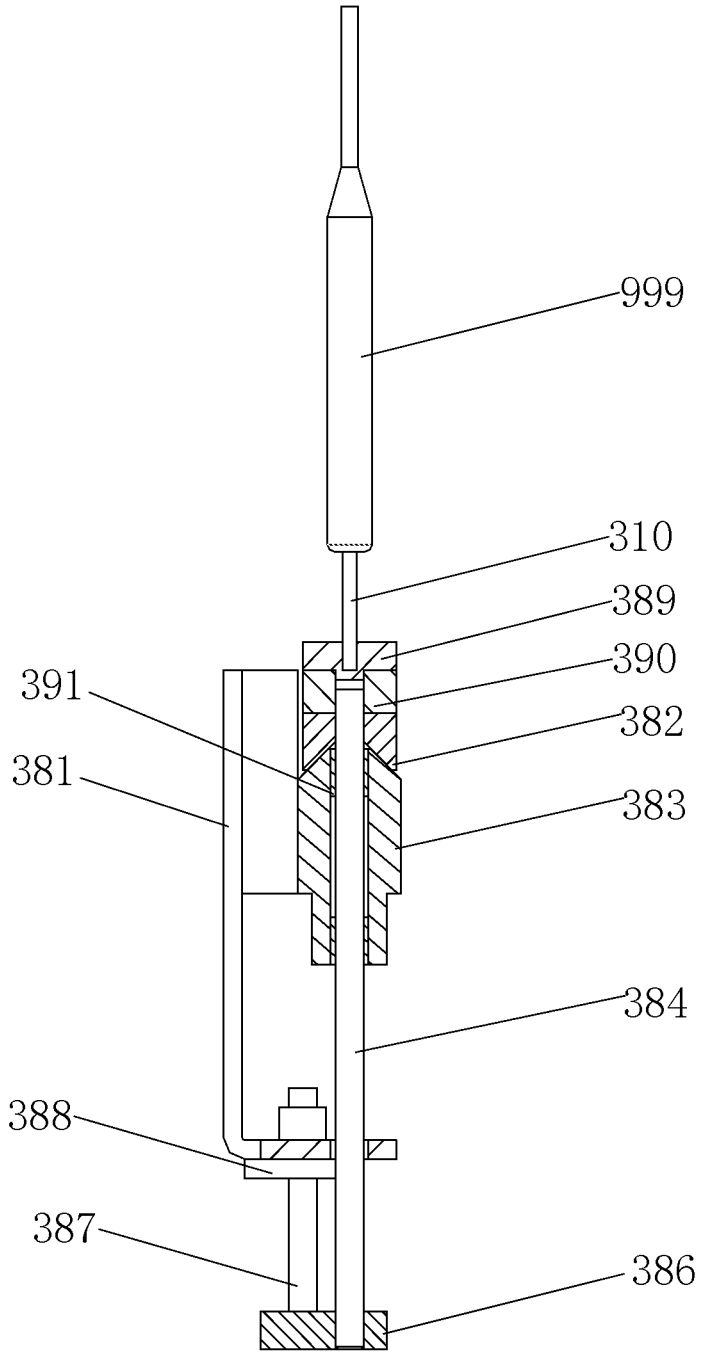
FIG. 16 is a cross-section schematic diagram of a rough-grinding axial-direction locating device in the integrated rotary cutting tool manufacturing device provided by embodiments of the present disclosure.

Specifically, as show in FIG. 15 and FIG. 16, the rough grinding device further comprises a rough-grinding axial-direction locating device for workpieces, which may be used for locating an axial location of a cutting edge part to be machined of a PCB micro cutter. The rough-grinding axial-direction locating device comprises a first locating seat 381 and a first ejector pin 310 that is in contact with the end part of the workpiece and may axially slide relative to the first locating seat 381, the first ejector pin 310 is connected with a first locating taper sleeve 382, the first locating seat 381 is connected with a first locating taper seat 383, a locating taper surface is arranged between the first locating taper sleeve 382 and the first locating taper seat 383, the first ejector pin 310 is connected with a first sliding guide rod 384, the first sliding guide rod 384 penetrates through the first locating taper seat 383 and is connected with the first locating taper sleeve 382, and the first sliding guide rod 384 is connected with a first axial driving component 385 used for driving the first sliding guide rod 384 to slide in the axial direction. In the embodiments, a reversely tapered protrusion part is arranged at the upper end of the first locating taper seat 383, and a reversely tapered groove matching with the reversely tapered protrusion part is formed in the lower end of the first locating taper sleeve 382, so that the reversely tapered protrusion part and the reversely tapered groove form a locating structure, the locating effects are great, the axial direction and the radial direction of the workpiece 999 are simultaneously precisely located, the first ejector pin 310 is not easy to bend and deform, the axial line of the workpiece is not easy to deviate, the workpiece is located accurately, the machining precision of the workpiece is further improved, and the device may be greatly suitable for vertically machining the workpiece, such as the micro drill bit and the like. The first ejector pin 310 and the first sliding guide rod 384 are vertically arranged.

Specifically, as show in FIG. 15 and FIG. 16, a rotation stopping mechanism is arranged between the first sliding guide rod 384 and the first locating seat 381.

Specifically, as show in FIG. 15 and FIG. 16, the rotation stopping mechanism comprises a first connecting plate 386 fixedly connected with the first sliding guide rod 384, a first rotation stopping guide rod 387 is arranged between the first connecting plate 386 and the first locating seat 381, the first rotation stopping guide rod 387 and the first sliding guide rod 384 are arranged in parallel, and the first axial driving component 385 is connected with the first connecting plate 386.

Specifically, as show in FIG. 15 and FIG. 16, one end of the first sliding guide rod 384 is in sliding connection with the first connecting plate 386, and the other end of the first sliding guide rod 384 is connected with a first anti-rotating sleeve 388.

Specifically, as show in FIG. 15 and FIG. 16, a first insulating connecting component 390 is arranged between the first ejector pin 310 and the first sliding guide rod 384.

Specifically, as show in FIG. 15 and FIG. 16, the tail end of the first ejector pin 310 is fixedly connected with a first fixing sleeve 389, the first insulating connecting component 390 is arranged between the first fixing sleeve 389 and the first locating taper sleeve 382, the first insulating connecting component 390 and the first locating taper sleeve 382 sleeve the upper end of the first sliding guide rod 384, and an interval is reserved between the first fixing sleeve 389 and the first sliding rod.

Specifically, the first axial driving component 385 is an air cylinder or an oil cylinder.

Specifically, as show in FIG. 15 and FIG. 16, a first shaft sleeve 391 sleeving the first sliding guide rod 384 is arranged in the first locating taper seat 383, thereby facilitating precise and reliable sliding of the first sliding guide rod 384.

Specifically, the rough-grinding axial-direction locating device further comprises a first electric signal detector used for detecting whether the workpiece and the first ejector pin 310 are in contact, and after powered on, the first electric signal detector may detect whether the workpiece and the first ejector pin 310 are in excellent contact.

Specifically, one end of the first electric signal detector is connected with the first clamping component used for clamping the workpiece, the other end of the first electric signal detector is connected with the first ejector pin 310 or the first fixing sleeve 389, and the first clamping component, the first ejector pin 310 and the first fixing sleeve 389 are made of metal materials.

During specific application, as shown in FIG. 15 and FIG. 16, the first axial driving component 385 (an air cylinder) drives the first connecting plate 386 to move upwards or downwards, and correspondingly drives the first sliding guide rod 384, the first locating taper sleeve 382, the first insulating component, the first fixing sleeve 389 and the first ejector pin 310 to move upwards or downwards; when the first connecting plate 386 moves upwards, the workpiece is pushed to move upwards, thereby facilitating withdrawing of the workpiece; and when the first connecting plate 386 moves downwards, the first locating taper sleeve 382 is leaned against the first locating taper seat 383 downwards, and the axial direction and the radial direction of the first ejector pin 310 are simultaneously and preciously located.

When the first connecting plate 386 moves upwards or downwards, the first sliding guide rod 384 mounted on the first connecting plate 386 is limited in the first anti-rotating sleeve 388 to slide upwards or downwards, so that the rotation of the first ejector pin 310 in the axial direction is located, and the precision of the first ejector pin 310 in the axial direction and the radial location is further improved.

The first insulating connecting component 390 insulates the first fixing sleeve 389 from the first locating taper sleeve 382, and cooperates with the workpiece clamping mechanism (the first clamping component) to utilize the electrical conductivity of the first clamping component, the first ejector pin 310 and the workpiece to detect an electric signal so as to detect whether the end face of the shank of the workpiece is in contact with the first ejector pin 310. Therefore, axial location is changed from oil cylinder location to taper surface location, and radial location of the ejector rod is changed from shaft sleeve location to combined location of the first locating taper sleeve 382 and the first shaft sleeve 391, so the machining precision of the workpiece is further improved, and the device may be greatly suitable for vertically machining workpieces such as micro drill bits and the like.

Specifically, the fine grinding device further comprises a fine-grinding axial-direction locating device for workpieces, the fine-grinding axial-direction locating device and the rough-grinding axial-direction locating device have approximately the same structure, and the fine-grinding axial-direction locating device may be used for locating the axial location of the cutting edge part to be machined of the PCB micro cutter. The fine-grinding axial-direction locating device comprises a second locating seat and a second ejector pin 510 that is in contact with the end part of the workpiece and may axially slide relative to the second locating seat, the second ejector pin 510 is connected with a second locating taper sleeve, the second locating seat is connected with a second locating taper seat, a locating taper surface is arranged between the second locating taper sleeve and the second locating taper seat, the second ejector pin 510 is connected with a second sliding guide rod, the second sliding guide rod penetrates through the second locating taper seat and is connected with the second locating taper sleeve, and the second sliding guide rod is connected with a second axial driving component used for driving the second sliding guide rod to slide in the axial direction. In the embodiments, a reversely tapered groove is arranged at the upper end of the second locating taper seat, and a reversely tapered protrusion part matching with the reversely tapered groove is formed in the lower end of the second locating taper sleeve, so that the reversely tapered protrusion part and the reversely tapered groove form a locating structure, the locating effects are great, the axial direction and the radial direction of the workpiece are simultaneously precisely located, the second ejector pin 510 is not easy to bend and deform, the axial line of the workpiece is not easy to deviate, the workpiece is located accurately, the machining precision of the workpiece is further improved, and the device may be greatly suitable for vertically machining the workpiece, such as the micro drill bit and the like. The second ejector pin 510 and the second sliding guide rod are vertically arranged.

Specifically, a rotation stopping mechanism is arranged between the second sliding guide rod and the second locating seat.

Specifically, the rotation stopping mechanism comprises a second connecting plate fixedly connected with the second sliding guide rod, a second rotation stopping guide rod is arranged between the second connecting plate and the second locating seat, the second rotation stopping guide rod and the second sliding guide rod are arranged in parallel, and the second axial driving component is connected with the second connecting plate.

Specifically, one end of the second sliding guide rod is in sliding connection with the second connecting plate, and the other end of the second sliding guide rod is connected with a second anti-rotating sleeve.

Specifically, a second insulating connecting component is arranged between the second ejector pin and the second sliding guide rod.

Specifically, the tail end of the second ejector pin 510 is fixedly connected with a second fixing sleeve, the second insulating connecting component is arranged between the second fixing sleeve and the second locating taper sleeve, the second insulating connecting component and the second locating taper sleeve sleeve the upper end of the second sliding guide rod, and an interval is reserved between the second fixing sleeve and the second sliding rod.

Specifically, the second axial driving component is an air cylinder or an oil cylinder.

Specifically, a second shaft sleeve sleeving the second sliding guide rod is arranged in the second locating taper seat, thereby facilitating precise and reliable sliding of the second sliding guide rod.

Specifically, the fine-grinding axial-direction locating device further comprises a second electric signal detector used for detecting whether the workpiece and the second ejector pin 510 are in contact, and after powered on, the second electric signal detector may detect whether the workpiece and the second ejector pin 510 are in excellent contact.

Specifically, one end of the second electric signal detector is connected with the second clamping component used for clamping the workpiece, the other end of the second electric signal detector is connected with the second ejector pin 510 or the second fixing sleeve, and the second clamping component, the second ejector pin 510 and the second fixing sleeve are made of metal materials.

During specific application, the second axial driving component (an air cylinder) drives the second connecting plate to move upwards or downwards, and correspondingly drives the second sliding guide rod, the second locating taper sleeve, the second insulating component, the second fixing sleeve and the second ejector pin 510 to move upwards or downwards; when the second connecting plate moves upwards, the workpiece is pushed to move upwards, thereby facilitating withdrawing of the workpiece; and when the second connecting plate moves downwards, the second locating taper sleeve is leaned against the second locating taper seat downwards, and the axial direction and the radial direction of the second ejector pin 510 are simultaneously and preciously located.

When the second connecting plate moves upwards or downwards, the second sliding guide rod mounted on the second connecting plate is limited in the second anti-rotating sleeve to slide upwards or downwards, so that the rotation of the second ejector pin 510 in the axial direction is located, and the precision of the second ejector pin 510 in the axial direction and the radial location is further improved.

The second insulating connecting component insulates the second fixing sleeve from the second locating taper sleeve, and cooperates with the workpiece clamping mechanism (the second clamping component) to utilize the electrical conductivity of the second clamping component, the second ejector pin 510 and the workpiece to detect an electric signal so as to detect whether the end face of the shank of the workpiece is in contact with the second ejector pin 510. Therefore, the axial location is changed from oil cylinder location to taper surface location, and the radial location of the ejector rod is changed from shaft sleeve location to combined location of the second locating taper sleeve and the second shaft sleeve, so the machining precision of the workpiece is further improved, and the device may be greatly suitable for vertically machining workpieces such as micro drill bits and the like.

The embodiment of the present disclosure further provide a rotary cutting tool manufacturing method, which adopts the foregoing integrated rotary cutting tool manufacturing device and comprises the following steps: loading a workpiece on the feeding device 800, vertically arranging the workpiece on the rough grinding device of the grinding devices through the workpiece transfer device, carrying out primary grinding on the vertically arranged workpiece in a radial feed manner through the rough grinding wheel 410 of the rough grinding device, vertically arranging the workpiece on the rough grinding device of the grinding devices through the workpiece transfer device, transferring the workpiece from the rough grinding device to the fine grinding device through the workpiece transfer device, carrying out secondary grinding on the vertically arranged workpiece in the radial feed manner through the fine grinding wheel 610 of the fine grinding device, and transferring the workpiece from the fine grinding device to the discharge device 800 through the workpiece transfer device.

Specifically, the workpiece is horizontally placed in the hopper 220 of the feeding device 800, and the workpiece transfer device turns the workpiece 90 degrees to be in a vertical state when transferring the workpiece from the hopper 220 to the rough grinding device.

In the rotary cutting tool manufacturing method provided by the embodiments of the present disclosure, the hopper 220 is utilized to load workpieces according to the feeding manner (the workpieces are horizontally arranged and stacked), each workpiece is vertically arranged at each machining station, and the tray 810 is utilized to load the workpieces according to the discharge manner (the workpieces are vertically and independently arranged in the hole of the tray 810), and each tray 810 is provided with a plurality of holes.

Table 1 shows measurement data of a micro drill bits manufactured by utilizing the integrated rotary cutting tool manufacturing device provided by the present disclosure and measurement data of the micro drill bits manufactured by utilizing a manufacturing device in the prior art, wherein at least twenty groups of data are collected, respectively. Table 2 shows statistic and analysis results according to the data in Table 1, so, it may be seen that: when a micro drill bit with the drill diameter standard value of 0.356 mm is manufactured by utilizing the technical scheme of the present disclosure, the maximum value, the minimum value and the average value of the drill diameter are closer to the standard values, the difference values between the maximum values and between the minimum values and the standard errors are relatively smaller, and the stabilization process capability index is 1.468, so the relative capability is excellent. By utilizing the technical scheme of the present disclosure, the maximum value, the minimum value and the average value of the roundness of the micro drill bit are closer to the standard values, the difference values between the maximum values and between the minimum values and the standard errors are relatively smaller, and the stabilization process capability index is 2.0242, so the stabilization process capability is greatly excellent. By utilizing the technical scheme of the present disclosure, the maximum value, the minimum value and the average value of the concentricity of the micro drill bit are closer to the standard values, the difference values between the maximum values and between the minimum values and the standard errors are relatively smaller, and the stabilization process capability index is 2.6657, so the stabilization process capability is greatly excellent.

TABLE 1

| | Experimental data in embodiments | | | Experimental data in prior art | | |
|---|---|---|---|---|---|---|
| Item | OD | Roundness | Concentricity | OD | Roundness | Concentricity |
| 1 | 0.3564 | 0.0001 | 0.0005 | 0.3573 | 0.0001 | 0.0011 |
| 2 | 0.3559 | 0.0002 | 0.0011 | 0.3565 | 0.0002 | 0.0014 |
| 3 | 0.3558 | 0.0004 | 0.0006 | 0.3565 | 0.0002 | 0.0018 |
| 4 | 0.3555 | 0.0002 | 0.0007 | 0.3563 | 0.0004 | 0.0013 |
| 5 | 0.3563 | 0.0001 | 0.0008 | 0.3562 | 0.0003 | 0.0005 |
| 6 | 0.3559 | 0.0002 | 0.0009 | 0.3563 | 0.0005 | 0.0024 |
| 7 | 0.3550 | 0.0003 | 0.0010 | 0.3565 | 0.0003 | 0.0020 |
| 8 | 0.3557 | 0.0002 | 0.0014 | 0.3554 | 0.0002 | 0.0004 |
| 9 | 0.3555 | 0.0002 | 0.0007 | 0.3556 | 0.0003 | 0.0034 |
| 10 | 0.3565 | 0.0003 | 0.0007 | 0.3571 | 0.0002 | 0.0019 |
| 11 | 0.3559 | 0.0002 | 0.0004 | 0.3552 | 0.0003 | 0.0019 |
| 12 | 0.3558 | 0.0002 | 0.0004 | 0.3554 | 0.0002 | 0.0020 |
| 13 | 0.3558 | 0.0002 | 0.0005 | 0.3552 | 0.0002 | 0.0017 |
| 14 | 0.3560 | 0.0002 | 0.0007 | 0.3572 | 0.0001 | 0.0017 |
| 15 | 0.3566 | 0.0002 | 0.0013 | 0.3569 | 0.0002 | 0.0013 |
| 16 | 0.3551 | 0.0003 | 0.0010 | 0.3569 | 0.0002 | 0.0026 |
| 17 | 0.3561 | 0.0002 | 0.0006 | 0.3565 | 0.0003 | 0.0022 |
| 18 | 0.3554 | 0.0002 | 0.0014 | 0.3562 | 0.0003 | 0.0025 |
| 19 | 0.3569 | 0.0004 | 0.0014 | 0.3561 | 0.0003 | 0.0024 |
| 20 | 0.3569 | 0.0002 | 0.0011 | 0.3566 | 0.0002 | 0.0018 |

TABLE 2

| Item | OD | Roundness | Concentricity |
|---|---|---|---|
| Standard value | 0.3560 | 0.0005 | 0.0025 |
| Upper limit value | 0.3580 | 0.0010 | 0.0050 |
| Lower limit value | 0.3540 | 0.0000 | 0.0000 |
| Experimental data in embodiments | | | |
| | OD | Roundness | Concentricity |
| Max value | 0.3569 | 0.0004 | 0.0014 |
| Max value | 0.3550 | 0.0001 | 0.0004 |
| Difference value | 0.0019 | 0.0003 | 0.0010 |
| Average value | 0.3560 | 0.0002 | 0.0009 |
| Standard error | 0.0005 | 0.0001 | 0.0003 |
| CP | 1.4680 | 2.0242 | 2.6657 |
| Experimental data in prior art | | | |
| | OD | Roundness | Concentricity |
| Max value | 0.3573 | 0.0005 | 0.0034 |
| Max value | 0.3552 | 0.0001 | 0.0004 |
| Difference value | 0.0021 | 0.0004 | 0.0030 |
| Average value | 0.3563 | 0.0003 | 0.0018 |
| Standard error | 0.0006 | 0.0001 | 0.0007 |
| CP | 1.2548 | 1.8957 | 1.1424 |

A reference process of the rotary cutting tool manufacturing method provided by the embodiments of the present disclosure is as follows:

in the embodiments, as shown in FIG. 1 to FIG. 14, the integrated rotary cutting tool manufacturing device is taken as a rough grinding and fine grinding integrated machining device which vertically clamps workpieces, wherein a plurality of workpieces (micro drill bits) are horizontally and orderly arranged in the hopper 220 of the feeding device 800, the discharge rod 230 is arranged at the lower part of the hopper 220, the workpiece pushing groove 231 of the discharge rod 230 horizontally pushes out the workpieces in the radial direction, the turning component 210 clamps one workpiece from the workpiece pushing groove 231 and turn the workpiece 90 degrees so as to turn the workpiece from the horizontal state to the vertical state, and at this point, the shank of the micro drill bit is arranged in a lower place and the drill edge part of the micro drill bit is arranged in an upper place.

The first clamping component of the workpiece transfer device 900 moves downwards, clamps the workpiece on the turning component 210 (a moving manipulator), moves upwards, rotates 90 degrees clockwise by taking the central rotating shaft 990 as the axial center, and then stops, at this point, the first clamping component with the workpiece reaches the upper part of the rough grinding device; next, the first clamping component moves downwards, and puts down the workpiece on the rough grinding device; and finally, the first clamping component moves upwards and stops till reaching the right position, rotates 90 degrees counterclockwise by taking the central rotating shaft 990 as the axial center, stops, and then waits for a next workpiece transferred by the turning component 210 (the moving manipulator).

In the rough grinding device, the top of the first ejector pin 310 blocks the workpiece 999, limits the workpiece to drop down, and locates the length of the workpiece; the first pressing driving component 370 (an air cylinder) pushes the first pressing wheel 350, presses the workpiece in an approximately triangle-shaped area formed by the rough-grinding guide plate 360, the first guide wheel 330 and the first pressing wheel 350, the first rotation driving component 331 (a motor) drives the first guide wheel 330 to rotate, the first guide wheel 330 rotates to directly drive the workpiece to rotate in one aspect and to drive the first intermediate friction wheel 340 to rotate in another aspect, the first intermediate friction wheel 340 rotates to drive the first pressing wheel 350 to rotate again, and the first pressing wheel 350 drives the workpiece to rotate again, thus, the workpiece is driven by two synchronous friction surfaces of the first guide wheel 330 and the first pressing wheel 350 to rotate to overcome the friction resistance of the rough-grinding guide plate 360 in a static state, the grinding force during machining and the like; a certain inclined angle exists between the axial line of the first guide wheel 330 and the axial line of the workpiece, so it may ensure that the end face of the shank of the workpiece is leaned against the end face of the head of the first ejector pin 310 when the workpiece rotates, thereby facilitating the length control of the part to be machined of the workpiece; and the rough-grinding support 380 is mounted on the rough grinding device, and the rough-grinding support 380 is used for balancing the pushing force generated when the rough grinding wheel 410 grinds the drill edge part of the workpiece.

In the rough grinding device, the rough-grinding feed driving component (a feed motor) drives the rough-grinding feed sliding table 420 in a sliding table forward direction to drive the rotating rough grinding wheel 410 to move from the radial direction to a direction close to the workpiece, thereby achieving rough grinding of the drill edge part of the workpiece; after the drill edge part of the workpiece is ground to a set size, the rough-grinding feed motor drives the rough-grinding feed sliding table 420 to move in a sliding table backward direction, thereby completing the rough grinding of the drill edge part of the workpiece; at this point, the workpiece may be detected; furthermore, the length of the roughly ground drill edge part may be adjusted by adjusting the lifting position of the rough-grinding lifting sliding plate 430, and the taper of the roughly ground drill edge part may be adjusted by adjusting the rotation angle of the rough-grinding angle adjusting plate 440 around the rotating shaft 441.

The second manipulator component 920 of the workpiece transfer device 900 moves downwards, clamps the workpiece on the rough grinding device, moves upwards, rotates 90 degrees clockwise by taking the central rotating shaft 990 as the axial center along with the rotating arm 940 of the workpiece transfer device 900, and then stops, at this point, the second manipulator component 920 with the workpiece reaches the upper part of the fine grinding device; next, the second manipulator component 920 moves downwards and puts down the workpiece on the fine grinding device; and finally, the second manipulator component 920 moves upwards and stops till reaching the right position, rotates 90 degrees counterclockwise by taking the central rotating shaft 990 as the axial center along with the rotating arm 940, stops and then waits for a next workpiece on the rough grinding device.

The workpiece clamping manner of the fine grinding device is as same as the workpiece clamping manner of the rough grinding device; and the fine-grinding support 580 is mounted on the fine grinding device, and the fine-grinding support 580 is used for balancing the pushing force generated when the fine grinding wheel 610 grinds the drill edge part of the workpiece.

In the fine grinding device, the fine-grinding feed driving component 631 (a feed motor) drives the fine-grinding feed sliding table 620 in a sliding table forward direction to drive the rotating fine grinding wheel 610 to move from the radial direction to a direction close to the workpiece, thereby achieving fine grinding of the drill edge part of the workpiece; after the drill edge part of the workpiece is ground to a set size, the fine-grinding feed motor 631 (the feed motor) drives the fine-grinding feed sliding table 620 to move in a sliding table backward direction, thereby completing the fine grinding of the drill edge part of the workpiece; furthermore, the length of the finely ground drill edge part may be adjusted by adjusting the lifting position of the fine-grinding lifting sliding plate, and the taper of the finely ground drill edge part may be adjusted by adjusting the rotation angle of the fine-grinding angle adjusting plate 640 around the rotating shaft 641.

The fine grinding wheel dresser 700 is used for dressing the fine grinding wheel 610, and may dress a cylindrical surface part and an angle part of the fine grinding wheel 610 when the ground workpiece cannot meet technical requirements after the shape of the drill edge part of the ground workpiece is changed. When the fine grinding wheel 610 is dressed, the base plate 751 is locked on the seat plate 752, the angle adjusting plate 740 is adjusted to rotate around a first rotating pin 741 till the zero-degree touch block reaches the right position, the angle rotating plate 740 is locked, the longitudinal sliding table moves up and down, simultaneously, the transverse sliding table slowly feeds to ensure that the fine-grinding-wheel-dressing abrasive stone 710 is in contact with the cylindrical surface part of the fine grinding wheel 610 in a rotating state, and then the transverse sliding table suitably feeds to ensure that the cylindrical surface part of the fine grinding wheel 610 is dressed; the above similar operations are carried out as follows: the angle adjusting plate 740 is adjusted to rotate around the first rotating pin 741 till the zero-degree touch block reaches the right position, the angle rotating plate 740 is locked, the longitudinal sliding table moves up and down, simultaneously, the transverse sliding table slowly feeds to ensure that the fine-grinding-wheel-dressing abrasive stone 710 is in contact with the angle part of the fine grinding wheel 610 in a rotating state, and then the transverse sliding table suitably feeds to ensure that the angle part of the fine grinding wheel 610 is dressed; and when the fine grinding wheel 610 needs to be changed, the base plate 751 is unlocked from the seat plate 752, the hook plate 753 rotates around the rotating pin 755 backwards, and the whole fine grinding wheel dresser 700 moves backwards to provide a space for taking out the fine grinding wheel 610.

The third manipulator component 930 (the third manipulator) of the workpiece transfer device 900 moves downwards, clamps the workpiece on the fine grinding device, moves upwards, rotates 90 degrees clockwise by taking the central rotating shaft 990 as the axial center along with the rotating arm 940 of the workpiece transfer device 900, and then stops, at this point, the third manipulator component 930 with the workpiece reaches the upper part of the discharge device 800; next, the third manipulator component 930 moves downwards and puts down the workpiece on the transfer base 820 of the discharge device 800; and finally, the third manipulator component 930 moves upwards and stops till reaching the right position, rotates 90 degrees counterclockwise by taking the central rotating shaft 990 as the axial center along with the rotating arm 940, stops and then waits for a next workpiece on the fine grinding device.

In the discharge device 800, the discharge manipulator 830 moves downwards, clamps the workpiece 999 on the transfer base 820, move upwards, and stops after reaching the right position; the discharge motor drives a discharge sliding block 850 to move, the discharge manipulator 830 moves along a slide rail along with the discharge sliding block 850, simultaneously a tray motor 840 drives the tray 810 to move along the slide rail 841 to ensure that a certain loading hole 811 of the tray 810 is aligned to the workpiece in the discharge manipulator 830, and the discharge manipulator 830 moves downwards and puts down the workpiece in the loading hole 811 of the tray 810, thereby completing the whole process of feeding one workpiece to discharging the workpiece in the tray 810.

Along with the reciprocating motion of the rotating arm 940 of the workpiece transfer device 900, the workpiece is transferred sequentially from the feeding device 800 to the rough grinding device to the fine grinding device to the discharge device 800, thereby achieving the whole process of feeding a workpiece, roughly machining the drill edge part of the workpiece, finely machining the drill edge part of the workpiece and discharging the workpiece in the tray 810.

According to the integrated rotary cutting tool manufacturing device and method, provided by the embodiments of the present disclosure, the workpiece is in the vertical state during grinding machining, so that the clamping and driving manners of the workpiece are changed, and the clamping, driving and rotating operations of the workpiece are acted on the same part of the shank of the workpiece; and furthermore, it may ensure that the axial center of the workpiece does not shift during rotating of the workpiece, so that the coaxiality error between the machined drill edge part and the shank is reduced. During grinding of the workpiece, the axial feed of the workpiece is changed to the radial feed, so that the grinding manner is changed, and the grinding efficiency is improved. Furthermore, a rough grinding station and a fine grinding station are separated and independent, so that the rough grinding machining precision is easy to detect; and at the machining stations, the workpiece is vertically arranged, thereby facilitating arrangement of functional parts of the device and saving the floor area of the device. The hopper 220 is utilized to feed the workpiece (the workpiece is horizontally arranged and stacked) according to the feeding manner, the tray 810 is utilized to load the workpiece according to the discharge manner, and the workpiece is vertically and independently arranged in the loading hole 811 of the tray 810; and the manipulators move to transfer the workpiece, thereby omitting a manual workpiece transfer process and improving the production efficiency.

The foregoing descriptions are merely exemplary embodiments of the present disclosure, but are not intended to limit the present disclosure. Any modification, equivalent replacement, and improvement made without departing from the spirit and principle of the present disclosure shall fall within the protection scope of the present disclosure.

What is claimed is:

1. An integrated rotary cutting tool manufacturing device, comprising a machine body, a feeding device used for loading workpieces to be ground, grinding devices used for grinding vertically arranged workpieces, and a discharge device used for loading ground workpieces, wherein the feeding device, the grinding devices and the discharge device all are connected with the machine body; the integrated rotary cutting tool manufacturing device further comprises a workpiece transfer device used for vertically transferring the workpieces to the grinding devices and the discharge device; and the grinding devices comprise a rough grinding device used for carrying out primary grinding on the vertically arranged workpieces and a fine grinding device used for carrying out secondary grinding on the vertically arranged workpieces;

wherein the workpiece transfer device comprises a central rotating shaft capable of rotating relative to the machine body and manipulators connected with the central rotating shaft and used for clamping the workpieces, and the feeding device, the rough grinding device, the fine grinding device and the discharge device are arranged around the circumference of the central rotating shaft;

wherein a turning component is arranged on one side of the feeding device and is used for turning a horizontally arranged workpiece to be vertically arranged; the manipulators comprise a first manipulator component used for transferring the workpiece on the turning component to the rough grinding device, and the first manipulator component is connected with the central rotating shaft; the first manipulator component comprises a first clamping component used for clamping the workpiece and capable of lifting up and down and a rotation driving component used for driving the first clamping component to turn the workpiece to be in a vertical state, and the rotation driving component is connected with the first clamping component; and the manipulators further comprise a second manipulator component used for transferring the workpiece from the rough grinding device to the fine grinding device in the vertical state, and the second manipulator component comprises a second clamping component used for clamping the workpiece and capable of lifting up and down.

2. The integrated rotary cutting tool manufacturing device according to claim 1, wherein the feeding device, the rough grinding device, the fine grinding device and the discharge device are arranged around the circumference of the workpiece transfer device.

3. The integrated rotary cutting tool manufacturing device according to claim 1, wherein the feeding device comprises a hopper used for containing horizontally arranged workpieces, the bottom of the hopper is provided with a discharge hole used for discharging the workpieces, a discharge rod used for pushing out the workpieces one by one is arranged below the discharge hole in a sliding manner, the discharge rod is provided with a workpiece pushing groove used for containing the workpieces that are discharged from the discharge hole, and the discharge rod is connected with a discharge driving component used for driving the discharge rod to slide.

4. The integrated rotary cutting tool manufacturing device according to claim 1, wherein the rough grinding device comprises a rough-grinding clamping stand and a rough grinding wheel stand; the rough-grinding clamping stand comprises a first ejector pin used for propping against the bottom of a workpiece to locate the axial position of the workpiece and a first driving component used for clamping the workpiece and driving the workpiece to rotate; and the rough grinding wheel stand comprises a rough grinding wheel and a rough-grinding feed driving component used for driving the rough grinding wheel to feed in a radial direction.

5. An integrated rotary cutting tool manufacturing device, comprising a machine body, a feeding device used for loading workpieces to be ground, grinding devices used for grinding vertically arranged workpieces, and a discharge device used for loading ground workpieces, wherein the feeding device, the grinding devices and the discharge device all are connected with the machine body; the integrated rotary cutting tool manufacturing device further comprises a workpiece transfer device used for vertically transferring the workpieces to the grinding devices and the discharge device; and the grinding devices comprise a rough grinding device used for carrying out primary grinding on the vertically arranged workpieces and a fine grinding device used for carrying out secondary grinding on the vertically arranged workpieces; wherein the fine grinding device comprises a fine-grinding clamping stand and a fine grinding wheel stand; the fine-grinding clamping stand comprises a second ejector pin used for propping against the bottom of a workpiece to locate the axial position of the workpiece and a second driving component used for clamping the workpiece and driving the workpiece to rotate; and the fine grinding wheel stand comprises a fine grinding wheel and a fine-grinding feed driving component used for driving the fine grinding wheel to feed in a radial direction; wherein the second driving component comprises a second guide wheel capable of pressing the side face of the workpiece to drive the workpiece to rotate, a second intermediate friction wheel driven by the second guide wheel and a second pressing wheel driven by the second intermediate friction wheel and capable of pressing the side face of the workpiece to drive the workpiece to rotate, the second intermediate friction wheel is connected with the second guide wheel and the second pressing wheel, the second guide wheel is connected with a second rotation driving component used for driving the second guide wheel to rotate, the fine-grinding clamping stand further comprises a fine-grinding guide plate, and the second pressing wheel is further connected with a second pressing driving component used for driving the second pressing wheel to press the side face of the workpiece.

6. The integrated rotary cutting tool manufacturing device according to claim 5, wherein the axial center of the second pressing wheel and the axial center of the workpiece are relatively inclined.

7. The integrated rotary cutting tool manufacturing device according to claim 5, wherein the fine-grinding clamping stand further comprises a fine-grinding support used for supporting the workpiece in a radial direction to balance the pressure.

8. The integrated rotary cutting tool manufacturing device according to claim 5, wherein the fine grinding wheel stand further comprises a fine-grinding lifting driving component used for driving the fine grinding wheel to slide in an axial direction and a fine-grinding angle adjusting plate used for adjusting an inclination angle of the fine grinding wheel relative to the workpiece.

9. The integrated rotary cutting tool manufacturing device according to claim 5, wherein the fine grinding device further comprises a fine grinding wheel dresser used for dressing the fine grinding wheel, the fine grinding wheel dresser comprises a fine-grinding-wheel-dressing abrasive stone, a fine-grinding-wheel-dressing lifting sliding table used for adjusting the fine-grinding-wheel-dressing abrasive stone, and a fine-grinding-wheel-dressing feed sliding table used for controlling the fine-grinding-wheel-dressing abrasive stone to feed towards the fine grinding wheel; and the fine grinding wheel dresser further comprises a fine-grinding-wheel-dressing angle adjusting component used for adjusting an inclination angle of the fine-grinding-wheel-dressing abrasive stone relative to the fine grinding wheel.

10. The integrated rotary cutting tool manufacturing device according to claim 9, wherein the fine grinding wheel dresser further comprises a base plate and a seat plate connected with the base plate, the fine-grinding-wheel-dressing feed sliding table comprises a transverse sliding table connected with the fine-grinding-wheel-dressing lifting sliding table, and the fine-grinding-wheel-dressing lifting sliding table comprises a longitudinal sliding table connected with the transverse sliding table; and the fine-grinding-wheel-dressing angle adjusting component comprises an angle adjusting plate, the angle adjusting plate is adjustably rotatably connected with the base plate through a first pin shaft, the longitudinal sliding table is connected with the angle adjusting plate, and the angle adjusting plate is connected with a zero-degree touch block.

11. An integrated rotary cutting tool manufacturing device, comprising a machine body, a feeding device used for loading workpieces to be ground, grinding devices used for grinding vertically arranged workpieces, and a discharge device used for loading ground workpieces, wherein the feeding device, the grinding devices and the discharge device all are connected with the machine body; the integrated rotary cutting tool manufacturing device further comprises a workpiece transfer device used for vertically transferring the workpieces to the grinding devices and the discharge device; and the grinding devices comprise a rough grinding device used for carrying out primary grinding on the vertically arranged workpieces and a fine grinding device used for carrying out secondary grinding on the vertically arranged workpieces, wherein the discharge device comprises a tray, the tray is provided with a plurality of loading holes used for allowing longitudinal insertion of the workpiece, a transfer base used for taking over the workpiece is arranged above or on one side of the tray, the transfer base is provided with a transfer hole used for allowing longitudinal insertion of the workpiece, and the discharge device further comprises a discharge manipulator used for transferring the workpiece from the transfer base to one loading hole.

12. A rotary cutting tool manufacturing method, wherein the integrated rotary cutting tool manufacturing device according to claim 1 is adopted, and comprising the following steps: loading a workpiece on the feeding device, vertically arranging the workpiece on the rough grinding device of the grinding devices through the workpiece transfer device, carrying out primary grinding on the vertically arranged workpiece in a radial feed manner through the rough grinding wheel of the rough grinding device, vertically arranging the workpiece on the rough grinding device of the grinding devices through the workpiece transfer device, transferring the workpiece from the rough grinding device to the fine grinding device through the workpiece transfer device, carrying out secondary grinding on the vertically arranged workpiece in the radial feed manner through the fine grinding wheel of the fine grinding device, and transferring the workpiece from the fine grinding device to the discharge device through the workpiece transfer device.

* * * * *